US011754958B2

(12) United States Patent
Ota

(10) Patent No.: US 11,754,958 B2
(45) Date of Patent: Sep. 12, 2023

(54) IMAGE FORMING APPARATUS HAVING WAE CONTROL FUNCTION

(71) Applicant: TOSHIBA TEC KABUSHIKI KAISHA, Tokyo (JP)

(72) Inventor: Hiroshi Ota, Ota Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 50 days.

(21) Appl. No.: 17/570,399

(22) Filed: Jan. 7, 2022

(65) Prior Publication Data

US 2023/0221669 A1 Jul. 13, 2023

(51) Int. Cl.
*G03G 15/00* (2006.01)
*G03G 15/20* (2006.01)

(52) U.S. Cl.
CPC ..... *G03G 15/5075* (2013.01); *G03G 15/2039* (2013.01)

(58) Field of Classification Search
CPC ..... G03G 15/5075–5091; G03G 15/2039–205
See application file for complete search history.

(56) References Cited

U.S. PATENT DOCUMENTS 9,104,147 B2 * 8/2015 Nagai ..... G03G 15/5004
9,300,136 B2 * 3/2016 Chosokabe ..... H02J 3/00
11,545,852 B1 * 1/2023 Caruso ..... H04L 41/145
2014/0185096 A1 7/2014 Tokunaga
2021/0364956 A1 11/2021 Usami

FOREIGN PATENT DOCUMENTS

JP 06-141101 5/1994
JP 06-202401 7/1994
JP 2019035822 A * 3/2019 ..... G03G 15/0178

* cited by examiner

*Primary Examiner* — Leon W Rhodes, Jr.
(74) *Attorney, Agent, or Firm* — AMIN, TUROCY & WATSON, LLP

(57) ABSTRACT

An image forming apparatus includes a heating member energization control circuit that estimates a temperature of a fixing rotating body, based on a temperature detection result of the fixing rotating body, which is heated by a heating member and heats a toner image formed on a medium to fix the toner image on the medium, by a temperature sensor, a power supply voltage of a power supply source, and an energization pulse for controlling energization to the heating member, and outputs an energization pulse for controlling power to be supplied to the heating member, based on the estimated temperature and the temperature detection result. The apparatus further includes a controller that acquires a power supply voltage detection result by a communication interface via a network, from another apparatus which holds a power supply voltage detection result by an image forming apparatus with a power supply voltage detection function, provided with a power supply voltage detection circuit that detects a power supply voltage value of a same power supply source as the power supply source, and inputs the acquired power supply voltage detection result to the heating member energization control circuit, as a power supply voltage value of the power supply source.

21 Claims, 12 Drawing Sheets

IMAGE FORMING APPARATUS HAVING WAE CONTROL FUNCTION

FIELD

Embodiments described herein relate generally to an image forming apparatus, a method, and a temperature regulation system all having a WAE control function.

BACKGROUND

An image forming apparatus includes a fixing unit that fixes a toner image on a print medium by applying heat and pressure to the print medium with the fixing unit. The fixing unit includes a fixing rotating body (heat roller, belt, or the like), a pressurizing member (press roller), a heating member (lamp, IH heater, or the like), and a temperature sensor. The temperature sensor detects the temperature of the surface of the fixing rotating body. The controller that controls the fixing unit controls the surface temperature of the fixing rotating body to be a target value by increasing or decreasing the energization amount to the heating member, based on the detection signal (temperature sensor signal) of the temperature sensor. If there is a deviation (or time lag) between the temperature detected by the temperature sensor and the surface temperature of the fixing rotating body, overshoot, temperature ripple, or the like may occur. In order to prevent the occurrence of such overshoot, temperature ripple, or the like, a temperature sensor with good responsiveness (for example, thermopile or the like) is required. However, a temperature sensor with good responsiveness has a problem of high cost.

Therefore, an image forming apparatus having a weighted average control with estimate temperature (WAE) control function is proposed. The heat transfer in the fixing unit can be expressed equivalently by the CR time constant of the electric circuit. That is, the heat capacity of the fixing unit is replaced by the capacitance C, and the heat transfer resistance is replaced by the resistance R. The heat source is replaced by a DC voltage source. The energization and disconnection from the DC voltage source are repeated based on the energization pulse, the CR circuit operates according to the input voltage pulse, the output voltage is generated, and the output voltage is applied to the heating member. The amount of heat propagated to the surface of the fixing rotating body to be controlled is estimated, based on the CR circuit in which the values of each element are set in advance based on the energization amount to the heating member and the heat capacity of the fixing rotating body. In the WAE control, by simulating as such a thermal CR circuit, the energization amount to the heating member is controlled based on the actual surface temperature of the fixing rotating body estimated from the energy input to the fixing unit, or the like, and the surface temperature of the fixing rotating body is set as a target value.

DETAILED DESCRIPTION

Figure 1:
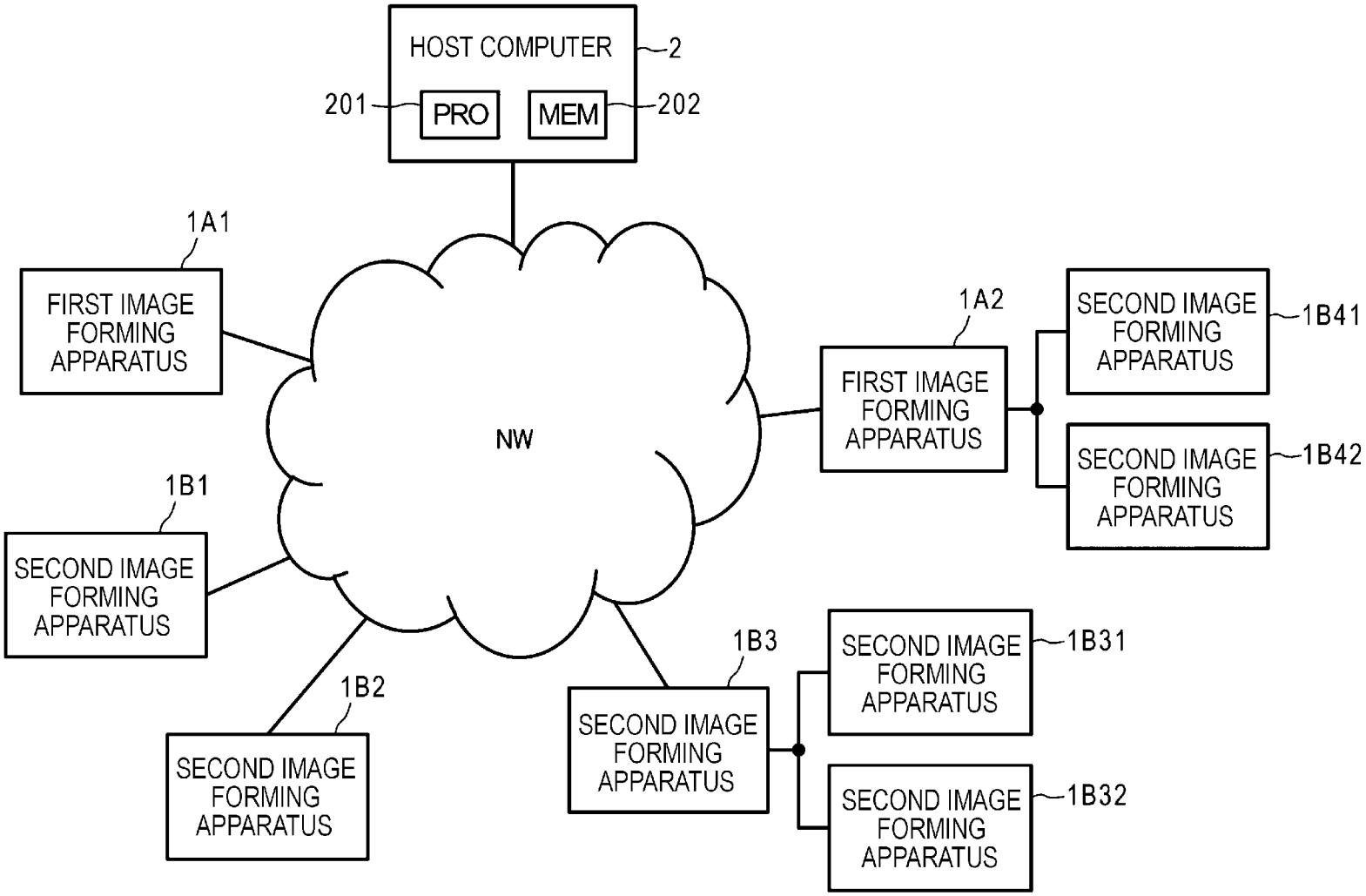
FIG. 1 is a diagram for explaining an example of a configuration of an image forming system including an image forming apparatus according to an embodiment.

Since the actual input voltage (input energy) can be known in the image forming apparatus provided with the power supply voltage detecting device, it becomes possible to more accurately estimate (calculate) in this WAE control.

However, in a copier without a power supply voltage detecting device, the estimation (calculation) is based on the designed reference value, so that there may be a deviation from the power supply situation in the installation environment of the image forming apparatus. In such a case, there is a problem that accurate estimation (calculation) cannot be performed with respect to the actual input voltage (input energy).

In general, according to one embodiment, an image forming apparatus including a fixing unit, a temperature sensor, a heating member energization control circuit, a communication interface, and a controller is provided. The fixing unit includes a fixing rotating body that heats a toner image formed on a medium and fixes the toner image on the medium, and a heating member that heats the fixing rotating body. The temperature sensor detects a temperature of the fixing rotating body to which heat propagates from the heating member, and outputs a temperature detection result. The heating member energization control circuit estimates the temperature of the fixing rotating body, based on the temperature detection result, a power supply voltage value of a power supply source, and an energization pulse for controlling energization to the heating member, and outputs an energization pulse for controlling the electric power supplied to the heating member, based on the estimated temperature of the fixing rotating body and the temperature detection result. The communication interface communicates with another apparatus via the network. A controller acquires a power supply voltage detection result by a communication interface via a network, from the other apparatus which holds the power supply voltage detection result by an image forming apparatus with a power supply voltage detection function, provided with a power supply voltage detection circuit that detects a power supply voltage value of a same power supply source as the power supply source, and inputs the acquired power supply voltage detection result to the heating member energization control circuit, as a power supply voltage value of the power supply source. According to another embodiment, a method involves detecting a temperature of a fixing rotating body to which heat propagates from a heating member of a fixing component, and outputting a temperature detection result; estimating the temperature of the fixing rotating body, based on the temperature detection result, a power supply voltage of a power supply source, and an energization pulse for controlling energization to the heating member, and outputting an energization pulse for controlling power to be supplied to the heating member based on the estimated temperature of the fixing rotating body and the temperature detection result; communicating with another apparatus via a network; and acquiring, from the another apparatus which holds a power supply voltage detection result by an image forming apparatus with a power supply voltage detection function, provided with a power supply voltage detection circuit that detects a power supply voltage value of a same power supply source as the power supply source, the power supply voltage detection result by the communication interface via the network, and inputting the acquired power supply voltage detection result, as the power supply voltage value of the power supply source.

Hereinafter, an image forming apparatus according to an embodiment will be described with reference to the drawings.

FIG. 1 is a diagram for explaining an example of a configuration of an image forming system including an image forming apparatus according to an embodiment.

In the example, the image forming system includes first image forming apparatuses 1A1 and 1A2, second image forming apparatuses 1B1, 1B2, 1B3, 1B31, 1B32, 1B41 and 1B42, and a host computer 2. In the following description, the first image forming apparatuses 1A1 and 1A2 are simply referred to as the first image forming apparatus 1A, if it is not necessary to distinguish between the first image forming apparatuses 1A1 and 1A2. Similarly, the second image forming apparatuses 1B1, 1B2, 1B3, 1B31, 1B32, 1B41 and 1B42 are also simply referred to as the second image forming apparatus 1B, if it is not necessary to distinguish between the second image forming apparatuses 1B1, 1B2, 1B3, 1B31, 1B32, 1B41 and 1B42. The first image forming apparatus 1A and the second image forming apparatus 1B are simply referred to as the image forming apparatus 1, if it is not necessary to distinguish between the first image forming apparatus 1A and the second image forming apparatus 1B. In the example, it is assumed that two first image forming apparatuses 1A and seven second image forming apparatuses 1B are included, but at least one of each may be provided. Note that in FIG. 1, a user terminal such as a personal computer that generates data on an image to be formed by each image forming apparatus 1 and transmits the data to each image forming apparatus 1 is not shown.

Each image forming apparatus 1 is arranged in the same building, the same floor, or the like, and is supplied with power from the same power supply source. That is, the power supply voltage of each image forming apparatus 1 has the same voltage value.

The first image forming apparatus 1A is an image forming apparatus including a power supply voltage detecting device, and each apparatus is connected to a network NW.

The second image forming apparatus 1B is an image forming apparatus that does not have a power supply voltage detecting device. The second image forming apparatuses 1B1, 1B2 and 1B3 are connected to the network NW. The second image forming apparatuses 1B31 and 1B32 are connected to the second image forming apparatus 1B3 via, for example, an in-house local area network (LAN), and the second image forming apparatuses 1B41 and 1B42 are connected to the first image forming apparatus 1A2 via, for example, an in-house LAN.

The host computer 2 is connected to the network NW. The host computer 2 includes a processor 201 and a memory 202. In FIG. 1, "processor" is described as "PRO" and "memory" is described as "MEM".

The processor 201 is an arithmetic element that executes arithmetic processing. The processor 201 is, for example, a CPU. The processor 201 performs various processes based on data such as a program stored in the memory 202. The processor 201 functions as a control unit capable of executing various operations by executing the program stored in the memory 202.

The memory 202 is a storage medium for storing a program and data used in the program. The memory 202 also functions as a working memory. That is, the memory 202 temporarily stores the data being processed by the processor 201, the program executed by the processor 201, and the like.

The processor 201 performs various information processes by executing the program stored in the memory 202. For example, the processor 201 stores the data transmitted from each first image forming apparatus 1A via the network NW in the memory 202. Further, the processor 201 transmits the data stored in the memory 202 to the second image forming apparatus 1B which is the request source in response to the request from the second image forming apparatus 1B transmitted via the network NW. The details of the processing of the processor 201 will be described later.

The network NW can be, for example, the Internet, an intranet, a LAN, a wide area network (WAN), or the like, and may include a wired or wireless network. For example, if each image forming apparatus 1 and the host computer 2 belong to one company, the network NW may be an in-house LAN independent of the external network.

Figure 2:
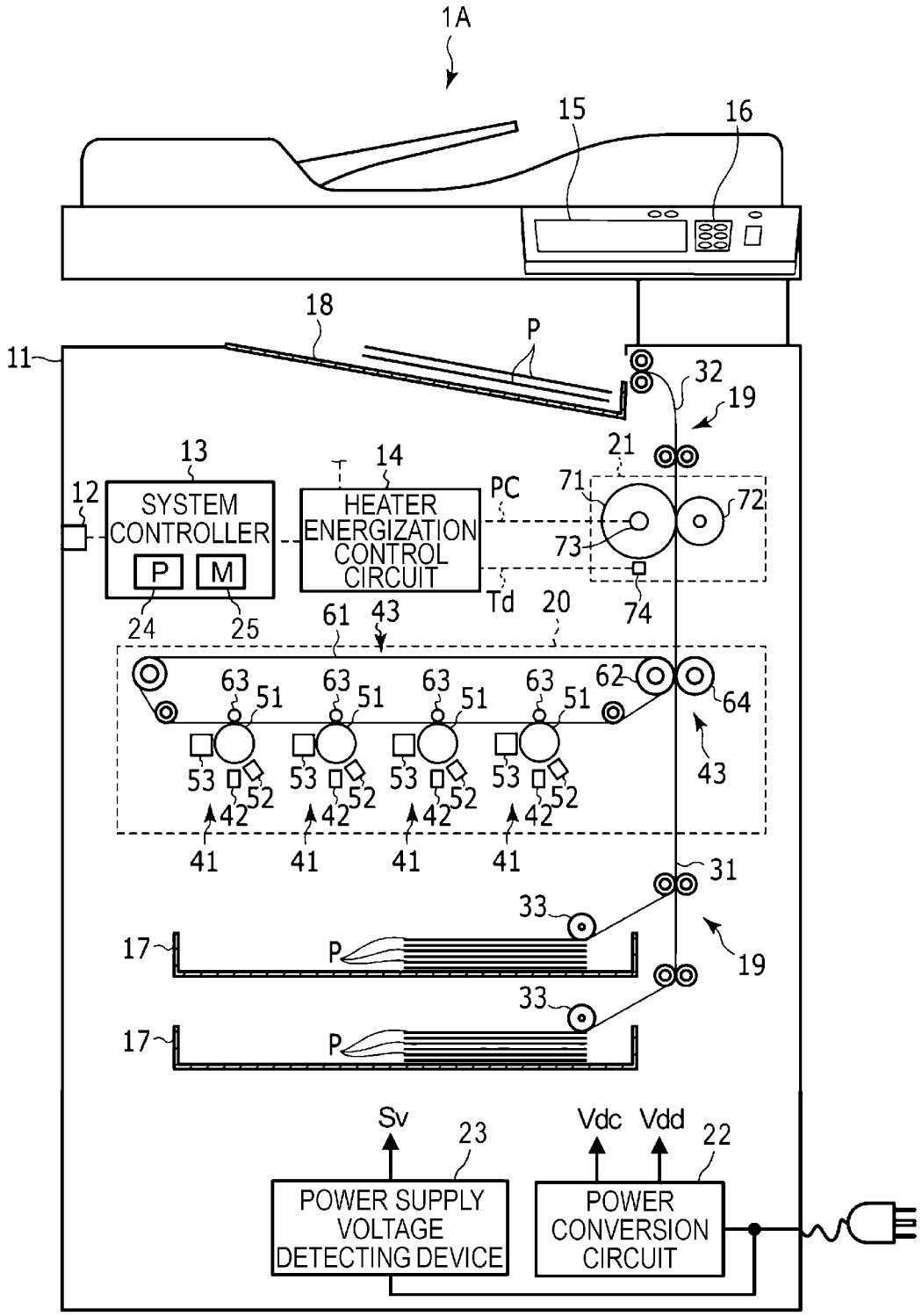
FIG. 2 is a diagram for explaining an example of a configuration of a first image forming apparatus in FIG. 1.

FIG. 2 is an explanatory diagram for explaining a configuration example of the first image forming apparatus 1A.

The first image forming apparatus 1A is, for example, a multifunction printer (MFP: Multifunction Peripheral) that performs various processes such as image formation while conveying a recording medium such as a print medium. The image forming apparatus 1A is, for example, a solid-state scanning printer (for example, an LED printer) that scans an LED array that performs various processes such as image formation while conveying a recording medium such as a print medium. For example, the image forming apparatus 1A receives toner from a toner cartridge and forms an image on a print medium by using the received toner. The toner may be a monochromatic toner, or may be a color toner of a color such as cyan, magenta, yellow, or black. Further, the toner may be a decolorable toner that decolorizes if heat is applied.

As shown in FIG. 2, the image forming apparatus 1A includes a housing 11, a communication interface 12, a system controller 13, a heater energization control circuit 14, a display unit 15, an operation interface 16, a plurality of paper trays 17, a paper ejection tray 18, a conveyance unit 19, an image forming unit 20, a fixing unit 21, a power conversion circuit 22, and a power supply voltage detecting device 23.

The housing 11 is the main body of the image forming apparatus 1A. The housing 11 accommodates the communication interface 12, the system controller 13, the heater energization control circuit 14, the display unit 15, the operation interface 16, the plurality of paper trays 17, the paper ejection tray 18, the conveyance unit 19, the image forming unit 20, the fixing unit 21, the power conversion circuit 22, and the power supply voltage detecting device 23.

First, the configuration of the control system of the image forming apparatus 1A will be described.

The communication interface 12 is an interface for communicating with other apparatuses. The communication interface 12 is used, for example, for communication with the host computer 2 via the network NW or communication with the second image forming apparatus 1B via the LAN. The communication interface 12 is configured as, for example, a LAN connector or the like. Further, the communication interface 12 may perform wireless communication with other apparatuses in accordance with a standard such as Bluetooth (registered trademark) or Wi-fi (registered trademark).

The system controller 13 controls the image forming apparatus 1A. The system controller 13 includes, for example, a processor 24 and a memory 25. In FIG. 2, the "processor" is described as "P" and the "memory" is described as "M".

The processor 24 is an arithmetic element that executes arithmetic processing. The processor 24 is, for example, a CPU. The processor 24 performs various processes based on data such as a program stored in the memory 25. The processor 24 functions as a control unit capable of executing various operations by executing the program stored in the memory 25.

The memory 25 is a storage medium for storing a program and data used in the program. The memory 25 also functions as a working memory. That is, the memory 25 temporarily stores the data being processed by the processor 24, the program executed by the processor 24, and the like. For example, in the present embodiment, the memory 25 holds the power supply voltage detection result Sv described later until the power is turned off.

The processor 24 performs various information processes by executing the program stored in the memory 25. For example, the processor 24 generates a print job, based on an image acquired from an external device such as a user terminal via the communication interface 12. The processor 24 stores the generated print job in the memory 25.

The print job includes image data indicating an image formed on the print medium P. The image data may be data for forming an image on one print medium P, or may be data for forming an image on a plurality of print media P. In addition, the print job contains information indicating whether the print is a color print or a monochrome print. Further, the print job may include information such as the number of copies to be printed (the number of page sets) and the number of prints per copy (the number of pages).

Further, the processor 24 generates print control information for controlling the operations of the conveyance unit 19, the image forming unit 20, and the fixing unit 21, based on the generated print job. The print control information includes information indicating the timing of paper passing. The processor 24 supplies print control information to the heater energization control circuit 14.

Further, the processor 24 functions as a controller (engine controller) that controls the operations of the conveyance unit 19 and the image forming unit 20 by executing the program stored in the memory 25. That is, the processor 24 controls the conveyance of the print medium P by the conveyance unit 19, the image formation on the print medium P by the image forming unit 20, and the like.

The image forming apparatus 1A may be configured to include an engine controller separately from the system controller 13. In this case, the engine controller controls the conveyance of the print medium P by the conveyance unit 19, the formation of an image on the print medium P by the image forming unit 20, and the like. Further, in this case, the system controller 13 supplies the engine controller with information necessary for control in the engine controller.

The power conversion circuit 22 supplies a DC voltage to various components in the image forming apparatus 1A by using the AC voltage of the AC power supply AC supplied from the power supply source. For example, the power conversion circuit 22 supplies the DC voltage Vdd required for the operation of the processor 24 and the memory 25 to the system controller 13. Further, the power conversion circuit 22 supplies the DC voltage required for image formation to the image forming unit 20. Further, the power conversion circuit 22 supplies the DC voltage required for conveying the print medium P to the conveyance unit 19. Further, the power conversion circuit 22 supplies the DC power supply voltage Vdc for driving the heater of the fixing unit 21 to the heater energization control circuit 14.

The power supply voltage detecting device 23 detects the voltage value of the AC voltage of the AC power supply AC supplied from the power supply source, and outputs the power supply voltage detection result Sv. The configuration of the power supply voltage detecting device 23 is not particularly limited. Anything can be used as long as the power supply voltage detecting device can detect the power supply voltage value. Further, the power supply voltage detecting device 23 may detect the voltage value of the DC power supply voltage Vdc converted by the power conversion circuit 22 instead of the voltage value of the AC voltage of the AC power supply AC supplied from the power supply source. The power supply voltage detection result Sv output by the power supply voltage detecting device 23 is input to the system controller 13. The processor 24 of the system controller 13 stores the power supply voltage value indicated by the power supply voltage detection result Sv in the memory 25. Further, the processor 24 can transmit the power supply voltage value to the host computer 2 via the network NW by the communication interface 12. Therefore, the memory 25 of the system controller 13 nonvolatilely stores the transmission destination information such as a network address of the host computer 2. Further, in response to an inquiry from the second image forming apparatus 1B, the processor 24 can transmit the power supply voltage value of the power supply voltage detection result Sv stored in the memory 25 by the communication interface 12 to the second image forming apparatus 1B connected to the first image forming apparatus 1A.

The heater energization control circuit 14 is a temperature control device (temperature control unit) that controls energization to a heater of the fixing unit 21, which will be described later. The heater energization control circuit 14 generates an energizing power PC for energizing the heater of the fixing unit 21 and supplies the energizing power PC to the heater of the fixing unit 21. A detailed description of the heater energization control circuit 14 will be described later.

The display unit 15 includes a display that displays a screen in response to a video signal input from a display control unit such as a system controller 13 or a graphic controller (not shown). For example, the display of the display unit 15 displays screens for various settings of the image forming apparatus 1A.

The operation interface 16 is connected to an operation member (not shown). The operation interface 16 supplies an operation signal corresponding to the operation of the operation member to the system controller 13. The operation member is, for example, a touch sensor, a numeric keypad, a power key, a paper feed key, various function keys, a keyboard, and the like. The touch sensor acquires information indicating a designated position within a certain area. The touch sensor is configured as a touch panel integrally with the display unit 15, so that a signal indicating the touched position on the screen displayed on the display unit 15 is input to the system controller 13.

Next, the configuration of the mechanical system of the image forming apparatus 1A will be described.

Each of the plurality of paper trays 17 is a cassette that houses the print medium P. The paper tray 17 is configured such that the print medium P can be supplied from the outside of the housing 11. For example, the paper tray 17 is configured to be pulled out of the housing 11.

The paper ejection tray 18 is a tray that supports the print medium P ejected from the image forming apparatus 1A.

Next, a configuration for conveying the print medium P of the image forming apparatus 1A will be described.

The conveyance unit 19 is a mechanism for conveying the print medium P in the image forming apparatus 1A. As shown in FIG. 2, the conveyance unit 19 includes a plurality of conveyance paths. For example, the conveyance unit 19 includes a paper feed conveyance path 31 and a paper ejection conveyance path 32.

The paper feed conveyance path 31 and the paper ejection conveyance path 32 are each composed of a plurality of motors, a plurality of rollers, and a plurality of guides (not shown). The plurality of motors rotate the shaft to rotate the rollers linked to the rotation of the shaft under the control of the system controller 13. The plurality of rollers rotate to move the print medium P. The plurality of guides control the conveyance direction of the print medium P.

The paper feed conveyance path 31 takes in the print medium P from the paper tray 17, and supplies the taken-in print medium P to the image forming unit 20. The paper feed conveyance path 31 includes a pickup roller 33 corresponding to each paper tray. Each pickup roller 33 takes in the print medium P of the paper tray 17 into the paper feed conveyance path 31.

The paper ejection conveyance path 32 is a conveyance path for ejecting the print medium P on which the image is formed from the housing 11. The print medium P ejected through the paper ejection conveyance path 32 is supported by the paper ejection tray 18.

Next, the image forming unit 20 will be described.

The image forming unit 20 is configured to form an image on the print medium P. Specifically, the image forming unit 20 forms an image on the print medium P, based on the print job generated by the processor 24.

The image forming unit 20 includes a plurality of process units 41, a plurality of exposure devices 42, and a transfer mechanism 43. The image forming unit 20 includes an exposure device 42 for each process unit 41. Since the plurality of process units 41 and the plurality of exposure devices 42 have the same configurations, respectively, one process unit 41 and one exposure device 42 will be described respectively.

First, the process unit 41 will be described.

The process unit 41 is configured to form a toner image. For example, a plurality of the process units 41 are provided for respective types of toner. For example, the plurality of process units 41 correspond to color toners such as cyan, magenta, yellow, and black, respectively. Specifically, toner cartridges having toners with different colors are connected to the respective process units 41.

The toner cartridge includes a toner storage container and a toner delivery mechanism. The toner storage container is a container that contains toner. The toner delivery mechanism is a mechanism composed of a screw or the like that sends out toner in the toner storage container.

The process unit 41 includes a photosensitive drum 51, an electrifying charger 52, and a developing device 53.

The photosensitive drum 51 is a photoreceptor including a cylindrical drum and a photosensitive layer formed on the outer peripheral surface of the drum. The photosensitive drum 51 is rotated at a constant speed by a drive mechanism (not shown).

The electrifying charger 52 uniformly electrifies the surface of the photosensitive drum 51. For example, the electrifying charger 52 electrifies the photosensitive drum 51 to a uniform negative polarity potential (contrast potential), by applying a voltage (development bias voltage) to the photosensitive drum 51 using an electrifying roller. The electrifying roller is rotated by the rotation of the photosensitive drum 51 in a state where a predetermined pressure is applied to the photosensitive drum 51.

The developing device 53 is a device for adhering toner to the photosensitive drum 51. The developing device 53 includes a developer container, a stirring mechanism, a developing roller, a doctor blade, an auto toner control (ATC) sensor, and the like.

The developer container is a container that receives and contains the toner sent out from the toner cartridge. A carrier is contained in the developer container in advance. The toner sent out from the toner cartridge is stirred with the carrier by a stirring mechanism to form a developer in which the toner and the carrier are mixed. The carrier is contained in the developer container during the manufacture of the developing device 53.

The developing roller rotates in the developer container to attach the developer to the surface. The doctor blade is a member disposed at a predetermined distance from the surface of the developing roller. The doctor blade removes a part of the developer adhered to the surface of the rotating developing roller. Thus, a layer of a developer having a thickness corresponding to the distance between the doctor blade and the surface of the developing roller is formed on the surface of the developing roller.

The ATC sensor is, for example, a magnetic flux sensor having a coil and detecting a voltage value generated in the coil. The detection voltage of the ATC sensor changes depending on the density of the magnetic flux from the toner in the developer container. That is, the system controller 13 determines the concentration ratio (toner concentration ratio) of the toner remaining in the developer container to the carrier, based on the detection voltage of the ATC sensor. Based on the toner concentration ratio, the system controller 13 operates a motor (not shown) that drives a toner cartridge delivery mechanism to send out toner from the toner cartridge to the developer container of the developing device 53.

Next, the exposure device 42 will be described.

The exposure device 42 includes a plurality of light emitting elements. The exposure device 42 forms a latent image on the photosensitive drum 51 by irradiating the electrified photosensitive drum 51 with light from the light emitting element. The light emitting element is, for example, a light emitting diode (LED) or the like. One light emitting element is configured to irradiate one point on the photosensitive drum 51 with light. The plurality of light emitting elements are arranged in the main scanning direction, which is a direction parallel to the rotation axis of the photosensitive drum 51.

The exposure device 42 forms a latent image for one line on the photosensitive drum 51 by irradiating the photosensitive drum 51 with light by the plurality of light emitting elements arranged in the main scanning direction. Further, the exposure device 42 forms a latent image of a plurality of lines by continuously irradiating the rotating photosensitive drum 51 with light.

In the above configuration, if the surface of the photosensitive drum 51 electrified by the electrifying charger 52 is irradiated with light from the exposure device 42, an electrostatic latent image is formed. If the layer of the developer formed on the surface of the developing roller is close to the surface of the photosensitive drum 51, the toner contained in the developer adheres to the latent image formed on the surface of the photosensitive drum 51. Thus, a toner image is formed on the surface of the photosensitive drum 51.

Next, the transfer mechanism 43 will be described.

The transfer mechanism 43 has a configuration in which the toner image formed on the surface of the photosensitive drum 51 is transferred to the print medium P.

The transfer mechanism 43 includes, for example, a primary transfer belt 61, a secondary transfer opposing roller 62, a plurality of primary transfer rollers 63, and a secondary transfer roller 64.

The primary transfer belt 61 is an endless belt wound around the secondary transfer opposing roller 62 and a plurality of winding rollers. In the primary transfer belt 61, the inner surface (inner peripheral surface) is in contact with the secondary transfer opposing roller 62 and the plurality of winding rollers, and the outer surface (outer peripheral surface) is opposed to the photosensitive drum 51 of the process unit 41.

The secondary transfer opposing roller 62 is rotated by a motor (not shown). The secondary transfer opposing roller 62 rotates to convey the primary transfer belt 61 in a predetermined conveyance direction. The plurality of winding rollers are configured to be freely rotatable. The plurality of winding rollers rotate according to the movement of the primary transfer belt 61 by the secondary transfer opposing roller 62.

The plurality of primary transfer rollers 63 are configured to bring the primary transfer belt 61 into contact with the photosensitive drum 51 of the process unit 41. The plurality of primary transfer rollers 63 are provided so as to correspond to the photosensitive drums 51 of the plurality of process units 41. Specifically, the plurality of primary transfer rollers 63 are provided at positions facing the photosensitive drums 51 of the process units 41 corresponding to each primary transfer roller 63 with the primary transfer belt 61 interposed therebetween. The primary transfer roller 63 comes into contact with the inner peripheral surface side of the primary transfer belt 61 and displaces the primary transfer belt 61 toward the photosensitive drum 51. Thus, the primary transfer roller 63 brings the outer peripheral surface of the primary transfer belt 61 into contact with the photosensitive drum 51.

The secondary transfer roller 64 is provided at a position facing the primary transfer belt 61. The secondary transfer roller 64 comes into contact with the outer peripheral surface of the primary transfer belt 61 and applies pressure. Thus, a transfer nip is formed in which the secondary transfer roller 64 and the outer peripheral surface of the primary transfer belt 61 are in close contact with each other. If the print medium P passes through the transfer nip, the secondary transfer roller 64 presses the print medium P passing through the transfer nip against the outer peripheral surface of the primary transfer belt 61.

The secondary transfer roller 64 and the secondary transfer opposing roller 62 rotate to convey the print medium P supplied from the paper feed conveyance path 31 in a state of sandwiching the print medium P. Thus, the print medium P passes through the transfer nip.

In the above configuration, if the outer peripheral surface of the primary transfer belt 61 comes into contact with the photosensitive drum 51, the toner image formed on the surface of the photosensitive drum is transferred to the outer peripheral surface of the primary transfer belt 61. If the image forming unit 20 includes a plurality of process units 41, the primary transfer belt 61 receives a toner image from the photosensitive drums 51 of the plurality of process units 41. The toner image transferred to the outer peripheral surface of the primary transfer belt 61 is conveyed by the primary transfer belt 61 to the transfer nip in which the secondary transfer roller 64 and the outer peripheral surface of the primary transfer belt 61 are in close contact with each other. If the print medium P is present in the transfer nip, the toner image transferred to the outer peripheral surface of the primary transfer belt 61 is transferred to the print medium P in the transfer nip.

Next, a configuration related to fixing of the image forming apparatus 1A will be described.

The fixing unit 21 fixes the toner image on the print medium P on which the toner image is transferred. The fixing unit 21 operates based on the control of the system controller 13 and the heater energization control circuit 14. The fixing unit 21 includes a fixing rotating body, a pressurizing member, and a heating member. The fixing rotating body is, for example, a heat roller 71. The pressurizing member is, for example, a press roller 72. The heating member is, for example, a heater 73 that heats the heat roller 71. Further, the fixing unit 21 includes a temperature sensor (thermal sensor) 74 that detects the temperature of the surface of the heat roller 71.

The heat roller 71 is a fixing rotating body that is rotated by a motor (not shown). The heat roller 71 has a core metal formed of hollow metal and an elastic layer formed on the outer periphery of the core metal. In the heat roller 71, the inside of the core metal is heated by the heater 73 disposed inside the core metal formed in a hollow shape. The heat generated inside the core metal is transferred to the outside surface of the heat roller 71 (that is, the surface of the elastic layer). The fixing rotating body may be configured as an endless belt.

The press roller 72 is provided at a position facing the heat roller 71. The press roller 72 has a core metal formed of metal having a predetermined outer diameter, and an elastic layer formed on the outer periphery of the core metal. The press roller 72 applies pressure to the heat roller 71 by the stress applied from a tension member (not shown). If pressure is applied from the press roller 72 to the heat roller 71, a nip (fixing nip) in which the press roller 72 and the heat roller 71 are in close contact with each other is formed. The press roller 72 is rotated by a motor (not shown). The press roller 72 rotates to move the print medium P entering the fixing nip, and presses the print medium P against the heat roller 71. A release layer may be provided on the surface of the heat roller 71 and the press roller 72, respectively.

The heater 73 is a device that generates heat by the energizing power PC supplied from the heater energizing control circuit 14. The heater 73 is, for example, a halogen lamp heater. The heater 73 generates heat inside the core metal of the heat roller 71 by the electromagnetic waves radiated from the halogen lamp heater, if the energizing power PC supplied from the heater energization control circuit 14 energizes the halogen lamp heater which is a heat source. Further, the heater 73 may be, for example, an IH heater, a planar heater made of ceramic or stainless steel (SUS), or the like.

The temperature sensor 74 detects the temperature of the air on or near the surface of the heat roller 71. The number of temperature sensors 74 may be plural. For example, a plurality of temperature sensors 74 may be arranged in parallel to the rotation axis of the heat roller 71. The temperature sensor 74 may be provided at least at a position where a change in the temperature of the heat roller 71 can be detected. The temperature sensor 74 supplies a temperature detection result signal indicating the temperature detection result Td to the heater energization control circuit 14.

With the above configuration, the heat roller 71 and the press roller 72 apply heat and pressure to the print medium P passing through the fixing nip. The toner on the print medium P is melted by the heat given by the heat roller 71, and is applied to the surface of the print medium P by the pressure given by the heat roller 71 and the press roller 72. Thus, the toner image is fixed on the print medium P passing through the fixing nip. The print medium P passing through the fixing nip is introduced into the paper ejection conveyance path 32 and ejected to the outside of the housing 11.

Figure 3:
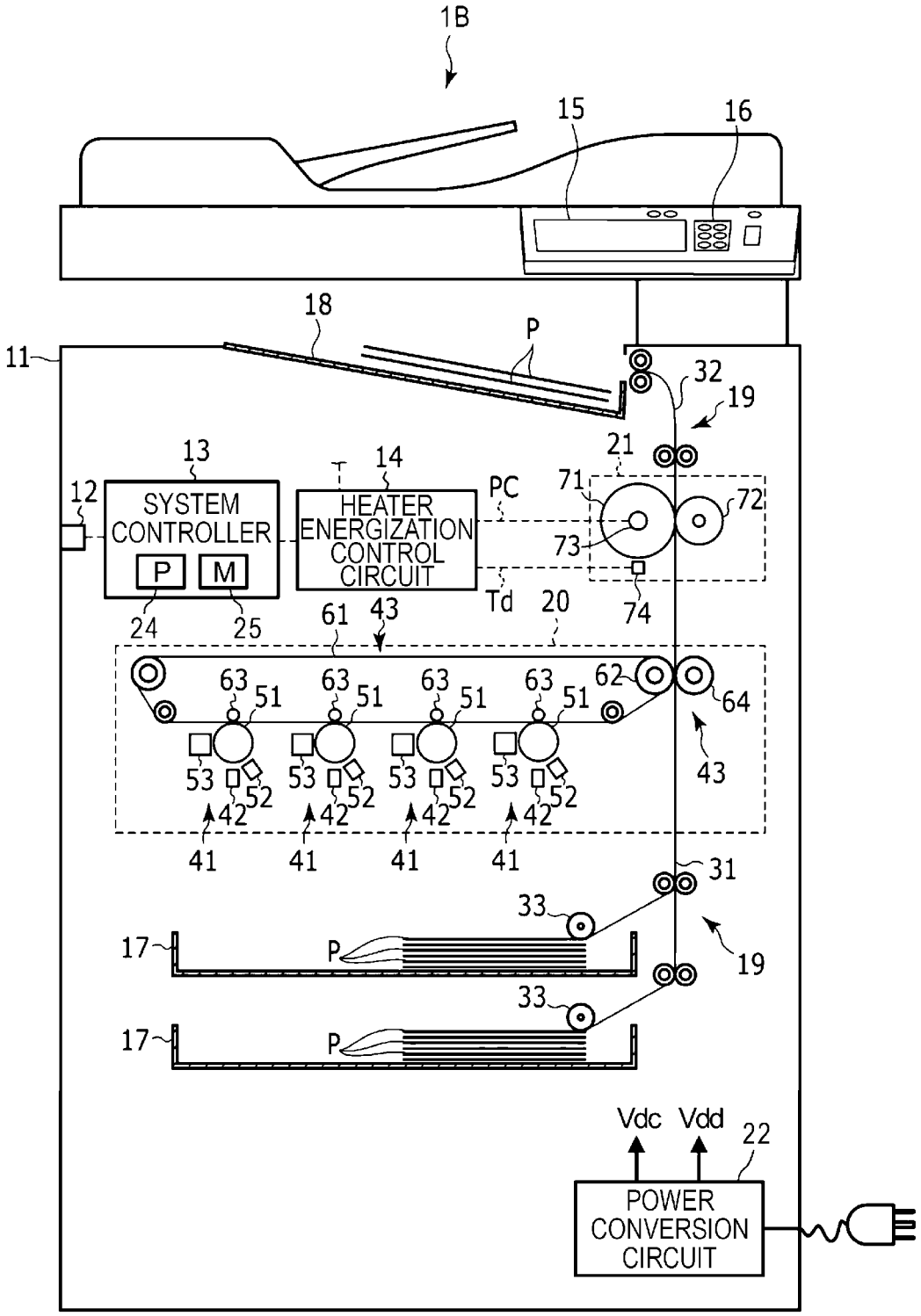
FIG. 3 is a diagram for explaining an example of a configuration of a second image forming apparatus in FIG. 1 as the image forming apparatus according to an embodiment.

FIG. 3 is a diagram for explaining an example of a configuration of a second image forming apparatus 1B as the image forming apparatus according to an embodiment. As shown in FIG. 3, the second image forming apparatus 1B has the same configuration as the first image forming apparatus 1A shown in FIG. 2 except that the second image forming apparatus 1B does not have the power supply voltage detecting device 23.

The processor 24 of the system controller 13 of the second image forming apparatus 1B can receive the power supply voltage value of the power supply voltage detection result Sv detected by the power supply voltage detecting device 23 of the first image forming apparatus 1A, from the host computer 2 via the network NW, by the communication interface 12, and store the received power supply voltage value in the memory 25. Therefore, the memory 25 of the system controller 13 nonvolatilely stores the transmission destination information such as the network address of the host computer 2.

Alternatively, the processor 24 can receive the power supply voltage value of the power supply voltage detection result Sv detected by the power supply voltage detecting device 23 of the first image forming apparatus 1A, from the first image forming apparatus 1A to which the second image forming apparatus 1B is connected, by the communication interface 12, and store the received power supply voltage value in the memory 25. Therefore, the memory 25 of the system controller 13 nonvolatilely stores the transmission destination information such as the network address of the first image forming apparatus 1A to which the second image forming apparatus 1B is connected.

Further, in response to an inquiry from the second image forming apparatus 1B, the processor 24 can transmit the power supply voltage value of the power supply voltage detection result Sv stored in the memory 25 by the communication interface 12 to another second image forming apparatus 1B connected to the second image forming apparatus 1B. Therefore, the memory 25 of the system controller 13 nonvolatilely stores the transmission destination information such as the network address of the other second image forming apparatus 1B.

Next, the heater energization control circuit 14 will be described.

The heater energization control circuit 14 controls energization to the heater 73 of the fixing unit 21. The heater energization control circuit 14 generates an energizing power PC for energizing the heater 73 of the fixing unit 21 and supplies the energizing power PC to the heater 73 of the fixing unit 21.

Figure 4:
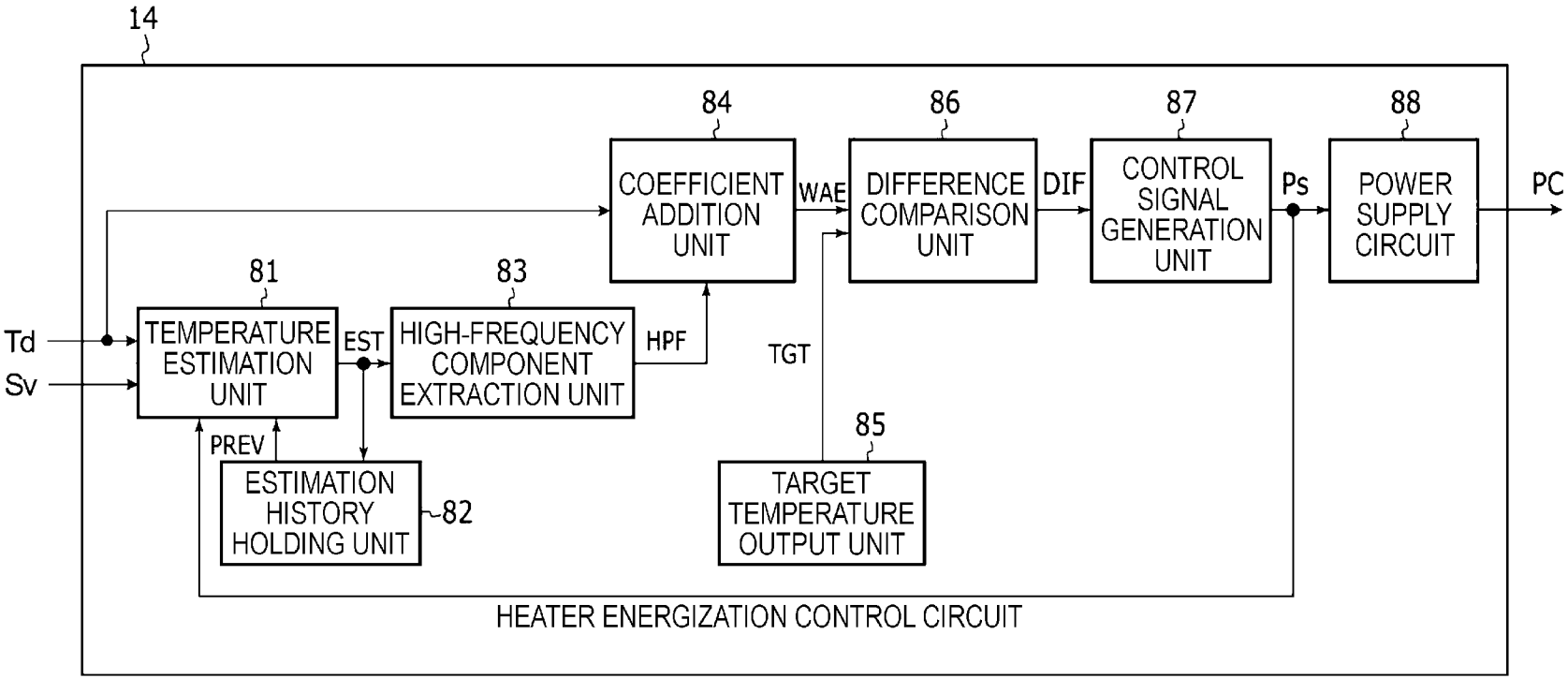
FIG. 4 is a diagram for explaining an example of a configuration of a heater energization control circuit in FIGS. 2 and 3.

FIG. 4 is a diagram for explaining an example of a configuration of the heater energization control circuit 14.

The heater energization control circuit 14 includes a temperature estimation unit 81, an estimation history holding unit 82, a high-frequency component extraction unit 83, a coefficient addition unit 84, a target temperature output unit 85, a difference comparison unit 86, a control signal generation unit 87, and a power supply circuit 88. Further, the temperature detection result Td from the temperature sensor 74 and the power supply voltage detection result Sv stored in the memory 25 of the system controller 13 are input to the heater energization control circuit 14.

The temperature estimation unit 81 performs a temperature estimation process for estimating the temperature of the surface of the heat roller 71. The temperature detection result Td from the temperature sensor 74, the power supply voltage detection result Sv from the system controller 13, the estimation history PREV from the estimation history holding unit 82 described later, and the pulse Ps from the control signal generation unit 87 described later are input to the temperature estimation unit 81. The temperature estimation unit 81 generates a temperature estimation result EST, based on the temperature detection result Td, the power supply voltage detection result Sv, the estimation history PREV, and the energization pulse Ps. The temperature estimation unit 81 outputs the temperature estimation result EST to the estimation history holding unit 82 and the high-frequency component extraction unit 83.

The estimation history holding unit 82 holds the history of the temperature estimation result EST. The estimation history holding unit 82 outputs the estimation history PREV, which is the history of the temperature estimation result EST (past temperature estimation result EST), to the temperature estimation unit 81.

The high-frequency component extraction unit 83 performs a high-pass filter process for extracting the high-frequency component of the temperature estimation result EST. The high-frequency component extraction unit 83 outputs the high-frequency component HPF, which is a signal indicating the extracted high-frequency component, to the coefficient addition unit 84.

The coefficient addition unit 84 performs a coefficient addition process for correcting the temperature detection result Td. The temperature detection result Td from the temperature sensor 74 and the high-frequency component HPF from the high-frequency component extraction unit 83 are input to the coefficient addition unit 84. The coefficient addition unit 84 corrects the temperature detection result Td, based on the high-frequency component HPF. Specifically, the coefficient addition unit 84 multiplies the high-frequency component HPF by a preset coefficient and adds the high-frequency component HPF multiplied by the coefficient to the temperature detection result Td to calculate the corrected temperature value WAE. The coefficient addition unit 84 outputs the corrected temperature value WAE to the difference comparison unit 86.

The target temperature output unit 85 outputs a preset target temperature TGT to the difference comparison unit 86.

The difference comparison unit 86 performs the difference calculation process. The difference comparison unit 86 calculates the difference DIF between the target temperature TGT from the target temperature output unit 85 and the corrected temperature value WAE from the coefficient addition unit 84, and outputs the calculated difference DIF to the control signal generation unit 87.

The control signal generation unit 87 generates energization pulses Ps, which are pulse signals for controlling energization to the heater 73, based on the difference DIF. The control signal generation unit 87 outputs the energization pulse Ps to the power supply circuit 88 and the temperature estimation unit 81.

The power supply circuit 88 supplies the energizing power PC to the heater 73, based on the energization pulse Ps. The power supply circuit 88 uses the DC power supply voltage Vdc supplied from the power conversion circuit 22 to energize the heater 73 of the fixing unit 21. The power supply circuit 88 supplies the energizing power PC to the heater 73 by switching between a state in which the DC power supply voltage Vdc from the power conversion circuit 22 is supplied to the heater 73 and a state in which the DC power supply voltage Vdc is not supplied, for example, based on the energization pulse Ps. That is, the power supply circuit 88 changes the time of energizing the heater 73 of the fixing unit 21, according to the energization pulse Ps.

The power supply circuit 88 may be integrally configured with the fixing unit 21. That is, the heater energization control circuit 14 may be configured to supply energization pulses Ps to the power supply circuit of the heater 73 of the fixing unit 21 instead of supplying the energizing power PC to the heater 73.

As described above, the heater energization control circuit 14 adjusts the amount of power to be supplied to the heater 73 of the fixing unit 21, based on the temperature detection result Td, the power supply voltage detection result Sv, the temperature estimation history PREV, and the energization pulse Ps. Thus, the heater energization control circuit 14 controls the surface temperature of the heat roller 71 heated by the heater 73. Such control is referred to as WAE control. Further, the temperature estimation unit 81, the estimation history holding unit 82, the high-frequency component extraction unit 83, the coefficient addition unit 84, the target temperature output unit 85, the difference comparison unit 86, and the control signal generation unit 87 of the heater energization control circuit 14 may be configured by an electric circuit or by software.

Hereinafter, the operations of the first image forming apparatus 1A, the second image forming apparatus 1B, and the host computer 2 in the image forming system will be described in detail.

Figure 5:
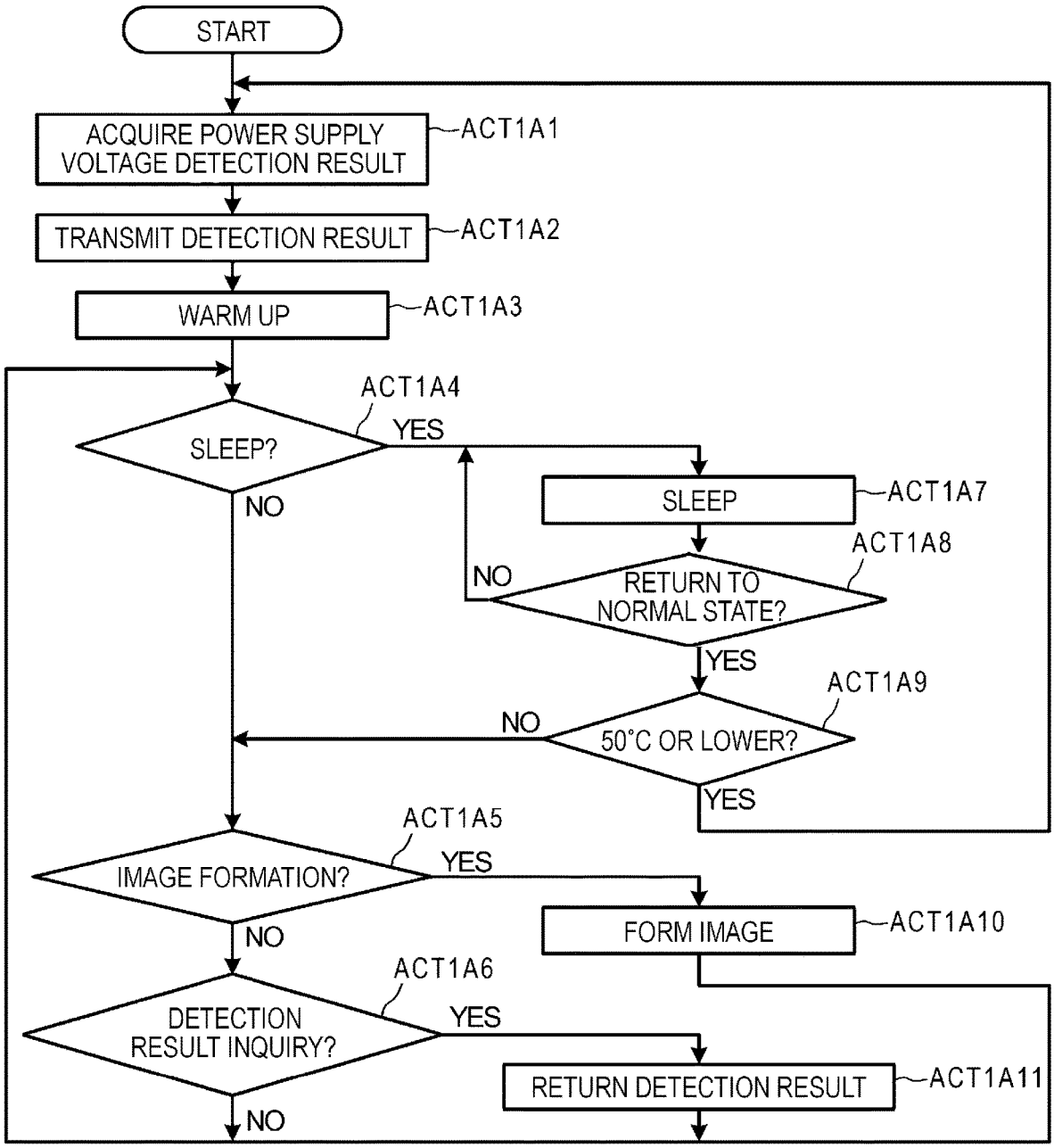
FIG. 5 is a flowchart for explaining an example of operation of the first image forming apparatus.

FIG. 5 is a flowchart for explaining an example of the operation of the first image forming apparatus 1A. If the power of the first image forming apparatus 1A is turned on, the processor 24 of the system controller 13 of the first image forming apparatus 1A executes the program stored in the memory 25 to perform the operation illustrated in this flowchart.

First, the processor 24 acquires the power supply voltage detection result Sv input from the power supply voltage detecting device 23 and stores the power supply voltage detection result Sv in the volatile area of the memory 25 (ACT 1A1). Then, the processor 24 transmits the stored power supply voltage detection result Sv to the host computer 2 via the network NW by the communication interface 12 (ACT 1A2).

Thereafter, the processor 24 performs a warm-up operation for raising the surface temperature of the heat roller 71 of the fixing unit 21, which requires a high temperature during the image formation operation, to a specified temperature (ACT 1A3). During the warm-up operation, the heater energization control circuit 14 performs WAE control based on the power supply voltage detection result Sv. Further, even after the warm-up operation is completed, the heater energization control circuit 14 controls the heater 73 such that the surface temperature of the heat roller 71 maintains the specified temperature.

If the warm-up operation is completed, the processor 24 determines whether or not to enter a sleep state (ACT 1A4). For example, if the processor 24 does not receive an image formation instruction from an external device such as a user terminal from the operation interface 16 or via the communication interface 12 for a predetermined fixed time, the processor 24 determines to shift to the sleep state. If it is determined not to enter the sleep state (ACT 1A4, NO), the processor 24 determines whether or not the image formation instruction is received (ACT 1A5). If it is determined that the image formation instruction is not received (ACT 1A5, NO), the processor 24 determines whether or not the inquiry about the power supply voltage detection result Sv is received, from the second image forming apparatus 1B connected by an in-house LAN or the like which is a network different from the network NW, by the communication interface 12 (ACT 1A6). If it is determined that the inquiry about the power supply voltage detection result Sv is not received (ACT 1A6, NO), the processor 24 shifts to the process of ACT 1A4.

If it is determined to enter the sleep state (ACT 1A4, YES), the processor 24 shifts to the sleep state (ACT 1A7). In the sleep state, the display of the display unit 15 is turned off or the energization to the heater 73 by the heater energization control circuit 14 is terminated in order to reduce the power consumption. The surface temperature of the heat roller 71 gradually decreases as the energization to the heater 73 ends.

Thereafter, the processor 24 determines whether or not to return from the sleep state to the normal state (ACT 1A8). For example, if the processor 24 receives an instruction from an external device such as a user terminal from the operation interface 16 or via the communication interface 12, the processor 24 determines to return to the normal state. If it is determined not to return to the normal state (ACT 1A8, NO), the processor 24 shifts to the process of ACT 1A7.

If it is determined to return to the normal state (ACT 1A8, YES), the processor 24 determines whether or not the fixing unit 21 is cold at that time. That is, the processor 24 determines whether or not the surface temperature of the heat roller 71 is a specified temperature, for example, 50° C. or lower, based on the temperature detection result Td from the temperature sensor 74 (ACT 1A9). It should be noted that 50° C. is an example, and it goes without saying that the temperature is not limited to this. If it is determined that the surface temperature of the heat roller 71 is 50° C. or lower (ACT 1A9, YES), the processor 24 shifts to the process of ACT 1A1. On the other hand, if it is determined that the surface temperature of the heat roller 71 is not 50° C. or lower (ACT 1A9, NO), the processor 24 shifts to the process of ACT 1A5.

Further, if it is determined that the image formation instruction is received (ACT 1A5, YES), the processor 24 executes the image formation operation (ACT 1A10). During the image formation operation, the heater energization control circuit 14 performs WAE control based on the power supply voltage detection result Sv. After the image formation operation is completed, the processor 24 shifts to the process of ACT 1A4.

If it is determined that the inquiry about the power supply voltage detection result Sv is received (ACT 1A6, YES), the processor 24 returns the power supply voltage detection result Sv stored in the memory 25 to the second image forming apparatus 1B which is the inquiry source by the communication interface 12 (ACT 1A11). Thereafter, the processor 24 shifts to the process of ACT 1A4.

Figure 6:
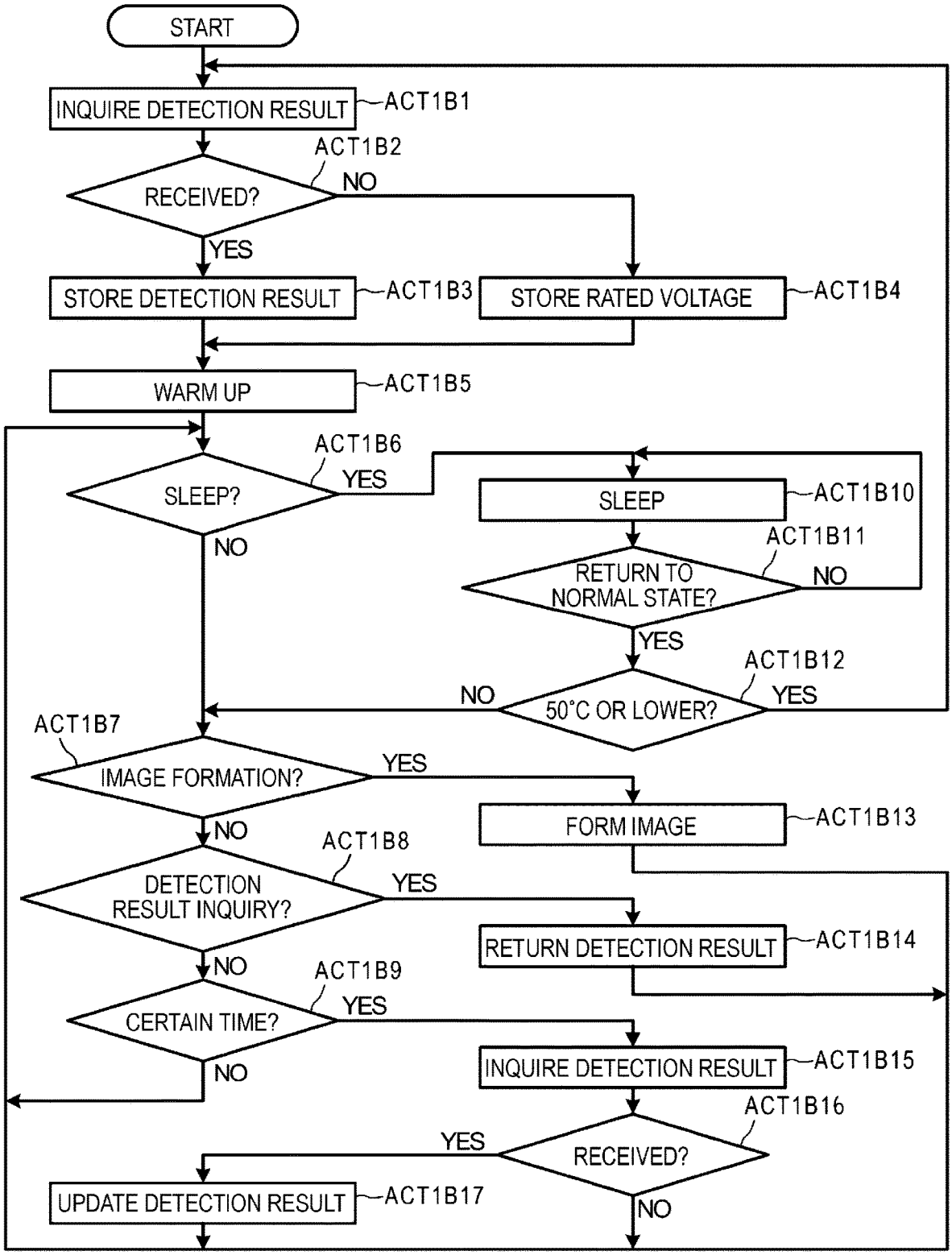
FIG. 6 is a flowchart for explaining an example of operation of the second image forming apparatus.

FIG. 6 is a flowchart for explaining an example of the operation of the second image forming apparatus 1B. If the power of the second image forming apparatus 1B is turned on, the processor 24 of the system controller 13 of the second image forming apparatus 1B executes the program stored in the memory 25 to perform the operation illustrated in this flowchart.

First, the processor 24 transmits the inquiry about the power supply voltage detection result Sv to the host computer 2 or the first image forming apparatus 1A or the other second image forming apparatus 1B, by the communication interface 12, according to the transmission destination information stored in the memory 25 (ACT 1B1).

Then, the processor 24 determines whether or not the power supply voltage detection result Sv returned from the inquiry destination of the power supply voltage detection result Sv is received (ACT 1B2).

Here, if it is determined that the power supply voltage detection result Sv is received (ACT 1B2, YES), the processor 24 stores the received power supply voltage detection result Sv in the memory 25 (ACT 1B3). Thereafter, the processor 24 shifts to the process of ACT 1B5 described later.

Further, if it is determined that the power supply voltage detection result Sv is not received even after a lapse of a certain period of time (ACT 1B2, NO), the processor 24 stores the rated voltage value, which is the designed value, in the memory 25 as the power supply voltage detection result Sv (ACT 1B4). Thereafter, the processor 24 shifts to the next ACT 1B5 process.

After storing the power supply voltage detection result Sv as described above, the processor 24 performs a warm-up operation for raising the surface temperature of the heat roller 71 of the fixing unit 21, which requires a high temperature during the image formation operation, to a specified temperature (ACT 1B5). During the warm-up operation, the heater energization control circuit 14 performs WAE control based on the power supply voltage detection result Sv received and stored in the memory 25. Further, even after the warm-up operation is completed, the heater energization control circuit 14 controls the heater 73 such that the surface temperature of the heat roller 71 maintains the specified temperature.

If the warm-up operation is completed, the processor 24 determines whether or not to enter the sleep state (ACT 1B6). If it is determined not to enter the sleep state (ACT 1B6, NO), the processor 24 determines whether or not the image formation instruction is received (ACT 1B7). If it is determined that the image formation instruction is not received (ACT 1B7, NO), the processor 24 determines whether or not the inquiry about the power supply voltage detection result Sv is received, from another second image forming apparatus 1B connected by an in-house LAN or the like which is a network different from the network NW, by the communication interface 12 (ACT 1B8). If it is determined that the inquiry about the power supply voltage detection result Sv is not received (ACT 1B8, NO), the processor 24 determines whether or not a certain period of time, for example, 10 minutes elapse after storing the power supply voltage detection result Sv in the memory 25 (ACT 1B9). It should be noted that 10 minutes is an example, and it goes without saying that the temperature is not limited to this. If it is determined that a certain time does not elapse (ACT 1B9, NO), the processor 24 shifts to the process of ACT 1A4.

If it is determined to enter the sleep state (ACT 1B6, YES), the processor 24 shifts to the sleep state (ACT 1B10). In the sleep state, the display of the display unit 15 is turned off or the energization to the heater 73 by the heater energization control circuit 14 is terminated in order to reduce the power consumption. The surface temperature of the heat roller 71 gradually decreases as the energization to the heater 73 ends.

Thereafter, the processor 24 determines whether or not to return from the sleep state to the normal state (ACT 1B11). If it is determined not to return to the normal state (ACT 1B11, NO), the processor 24 shifts to the process of ACT 1B10.

If it is determined to return to the normal state (ACT 1B11, YES), the processor 24 determines whether or not the fixing unit 21 is cold at that time. That is, the processor 24 determines whether or not the surface temperature of the heat roller 71 is a specified temperature, for example, 50° C. or lower, based on the temperature detection result Td from the temperature sensor 74 (ACT 1B12). If it is determined that the surface temperature of the heat roller 71 is 50° C. or lower (ACT 1B12, YES), the processor 24 shifts to the process of ACT 1B1. On the other hand, if it is determined that the surface temperature of the heat roller 71 is not 50° C. or lower (ACT 1B12, NO), the processor 24 shifts to the process of ACT 1B7.

Further, if it is determined that the image formation instruction is received (ACT 1B7, YES), the processor 24 executes the image formation operation (ACT 1B13). During the image formation operation, the heater energization control circuit 14 performs WAE control based on the power supply voltage detection result Sv. After the image formation operation is completed, the processor 24 shifts to the process of ACT 1B6.

Further, if it is determined that the inquiry about the power supply voltage detection result Sv is received (ACT 1B8, YES), the processor 24 returns the power supply voltage detection result Sv which is received and stored in the memory 25 to the second image forming apparatus 1B which is the inquiry source by the communication interface 12 (ACT 1B14). Thereafter, the processor 24 shifts to the process of ACT 1B6.

Further, if it is determined that a certain time elapses after storing the power supply voltage detection result Sv in the memory 25 (ACT 1B9, YES), the processor 24 transmits the inquiry about the power supply voltage detection result Sv to the host computer 2 or the first image forming apparatus 1A or the other second image forming apparatus 1B, by the communication interface 12, according to the transmission destination information stored in the memory 25 (ACT 1B15).

Then, the processor 24 determines whether or not the power supply voltage detection result Sv returned from the inquiry destination of the power supply voltage detection result Sv is received (ACT 1B16).

Here, if it is determined that the power supply voltage detection result Sv is received (ACT 1B16, YES), the processor 24 updates the power supply voltage detection result Sv stored in the memory 25 with the received power supply voltage detection result Sv (ACT 1B17). Thereafter, the processor 24 shifts to the process of ACT 1B6.

Further, if it is determined that the power supply voltage detection result Sv is not received even after a lapse of a certain period of time (ACT 1B16, NO), the processor 24 shifts to the process of ACT 1B6.

Figure 7:
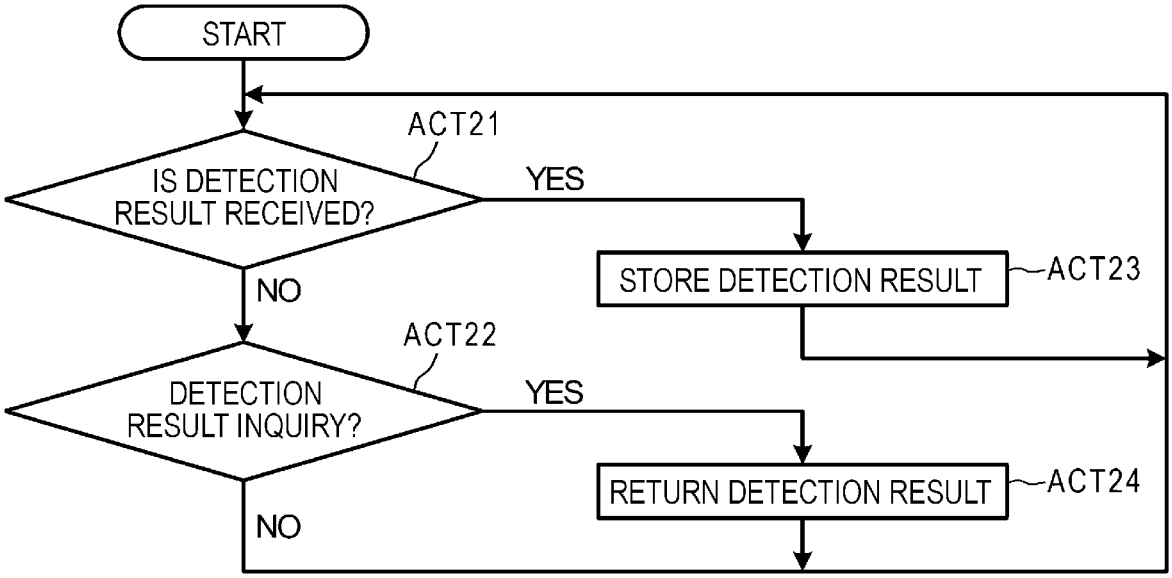
FIG. 7 is a flowchart for explaining an example of operation of a host computer in FIG. 1.

FIG. 7 is a flowchart for explaining an example of the operation of the host computer 2. If the power of the host computer 2 is turned on, the processor 201 of the host computer 2 executes the program stored in the memory 202 to perform the operation illustrated in this flowchart.

The processor 201 determines whether or not the power supply voltage detection result Sv transmitted from any first image forming apparatus 1A is received via the network NW by a communication interface (not shown) (ACT 21). If it is determined that the power supply voltage detection result Sv is not received (ACT 21, NO), the processor 201 determines whether or not the inquiry about the power supply voltage detection result Sv from any second image forming apparatus 1B is received via the network NW by the communication interface (ACT 22). If it is determined that the inquiry about the power supply voltage detection result Sv is not received (ACT 22, NO), the processor 201 shifts to the process of ACT 21.

If it is determined that the power supply voltage detection result Sv is received (ACT 21, YES), the processor 201 stores the received power supply voltage detection result Sv in the memory 202 (ACT 23). Thereafter, the processor 201 shifts to the process of ACT 21. At the time of the storage, the processor 201 can rewrite the power supply voltage detection result Sv stored in the memory 202 with the newly received power supply voltage detection result Sv. Alternatively, the processor 201 may calculate the average value of the voltage value of the power supply voltage detection result Sv stored in the memory 202 and the voltage value of the newly received power supply voltage detection result Sv, and store the calculated voltage value as the power supply voltage detection result Sv in the memory 202. Further, the processor 201 may store a predetermined number of received power supply voltage detection results Sv, for example, the latest 10 power supply voltage detection results Sv in the memory 202 as a history.

If it is determined that the inquiry about the power supply voltage detection result Sv is received (ACT 22, YES), the processor 201 returns the power supply voltage detection result Sv stored in the memory 202 to the second image forming apparatus 1B which is the inquiry source via the network NW by the communication interface (ACT 24). Thereafter, the processor 201 shifts to the process of ACT 21. If a predetermined number of power supply voltage detection results Sv are stored in the memory 202 in a history format, the processor 201 calculates the average value of the voltage values of the predetermined number of power supply voltage detection results Sv, and returns the calculated average value as the power supply voltage detection result Sv.

Next, the WAE control performed by the heater energization control circuit 14 during the warm-up operation and the image formation operation will be described in detail.

Figure 8:
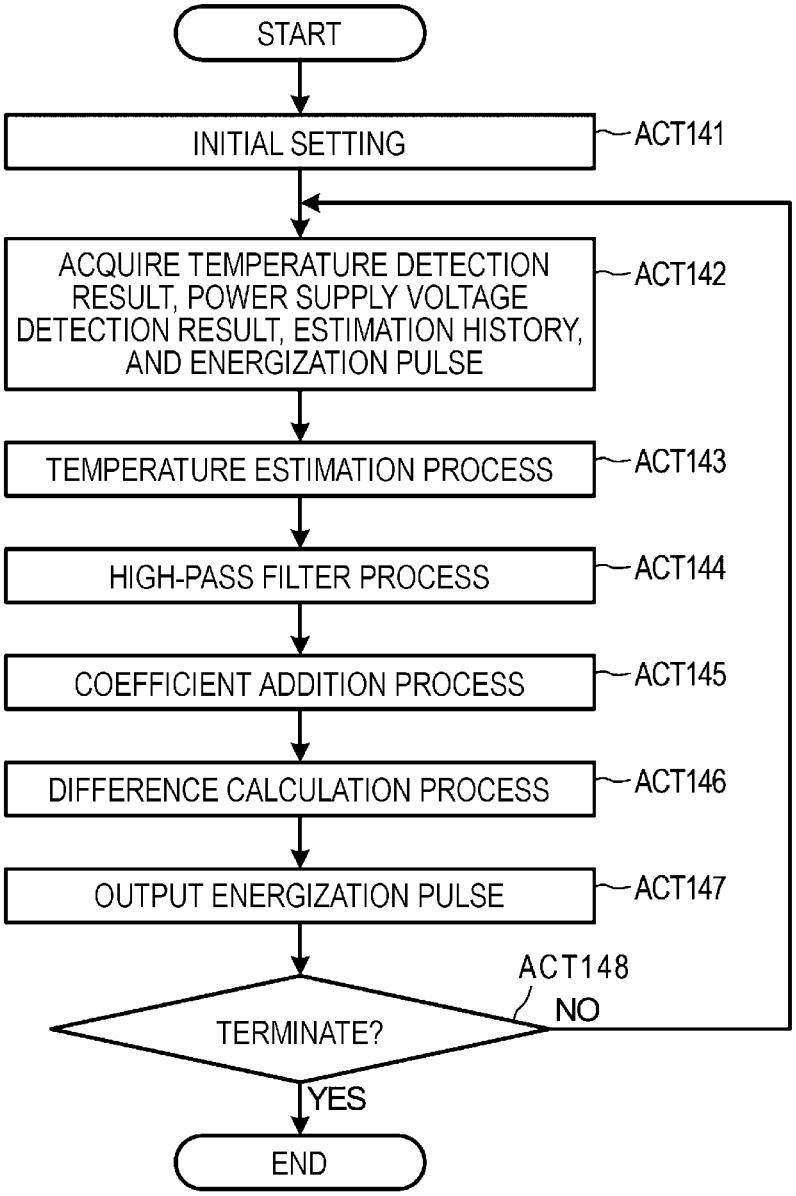
FIG. 8 is a flowchart for explaining an example of operation of the heater energization control circuit.
Figure 9:
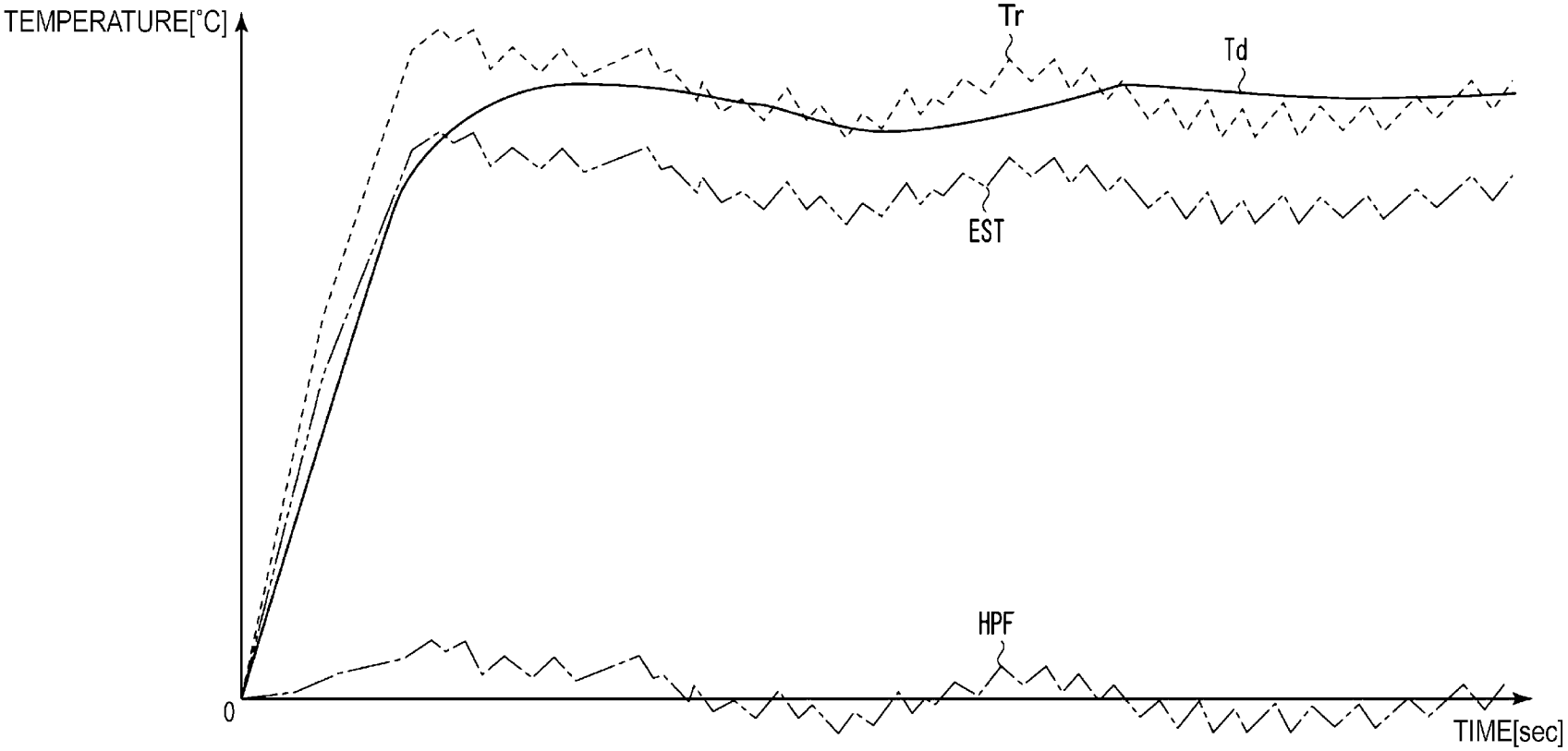
FIG. 9 is an explanatory diagram for explaining examples of a surface temperature of a heat roller, a temperature detection result, a temperature estimation result, and a high-frequency component of the temperature estimation result in WAE control.
Figure 10:
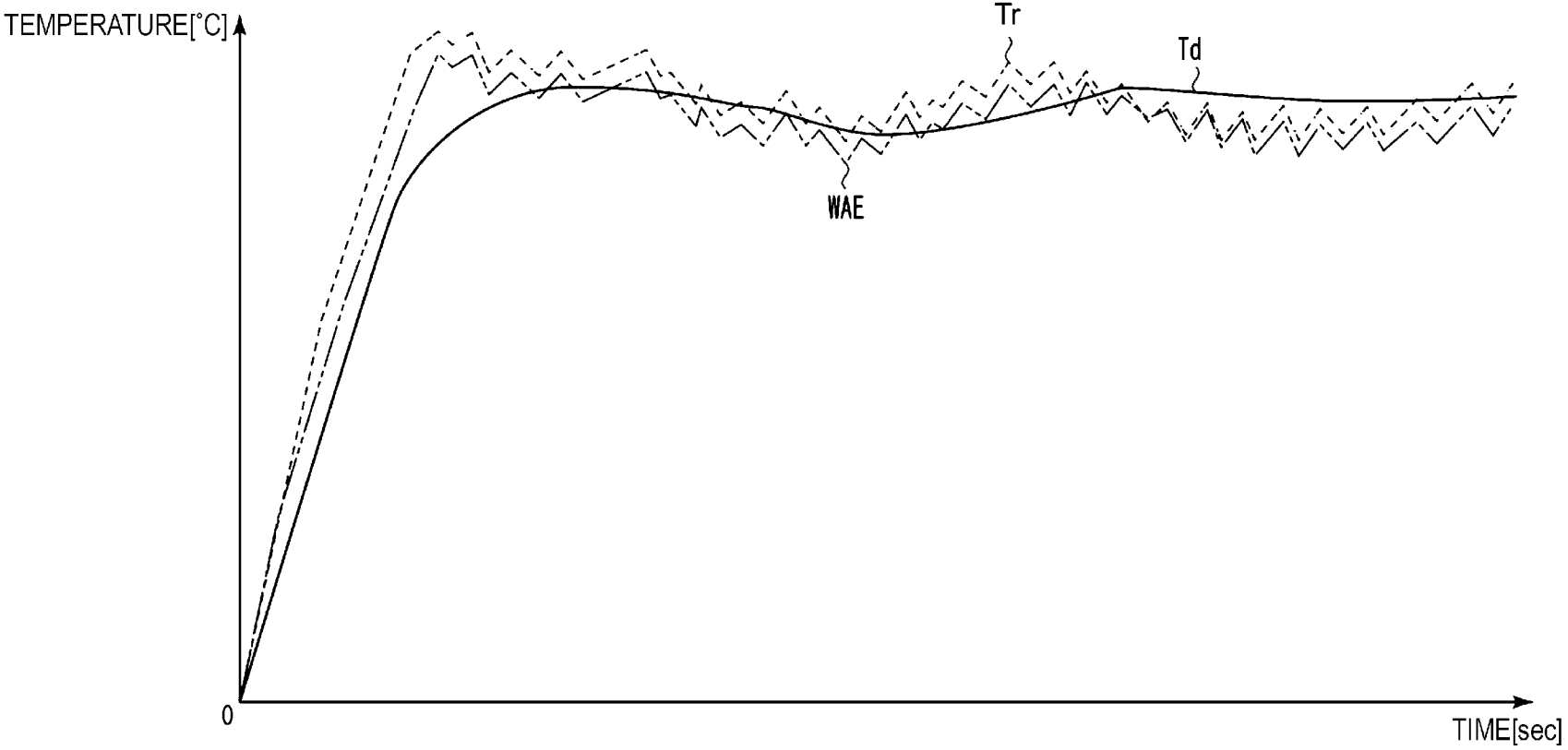
FIG. 10 is an explanatory diagram for explaining examples of a surface temperature of a heat roller, a temperature detection result, and a corrected temperature value in WAE control.

FIG. 8 is a flowchart for explaining an example of the operation of the heater energization control circuit 14. FIG. 9 is an explanatory diagram for explaining examples of the surface temperature Tr of the heat roller 71, the temperature detection result Td, the temperature estimation result EST, and the high-frequency component HPF of the temperature estimation result EST in WAE control, and similarly, FIG. 10 is an explanatory diagram for explaining examples of the surface temperature Tr of the heat roller 71, the temperature detection result Td, and the corrected temperature value WAE. The horizontal axis of FIGS. 9 and 10 indicates time, and the vertical axis indicates temperature.

First, the heater energization control circuit 14 sets various initial values (ACT 141). For example, the heater energization control circuit 14 sets the coefficient in the coefficient addition unit 84 and the target temperature TGT of the target temperature output unit 85, and the like, based on the signal from the system controller 13.

The temperature estimation unit 81 of the heater energization control circuit 14 acquires a temperature detection result Td from the temperature sensor 74, a power supply voltage detection result Sv from the system controller 13, an estimation history PREV from the estimation history holding unit 82, and an energization pulse Ps from the control signal generation unit 87, respectively (ACT 142).

As shown in FIG. 9, there is a difference between the temperature detection result Td and the actual surface temperature Tr of the heat roller 71. The surface temperature of the heat roller 71 varies with a fine cycle because the heating by the heater 73 is performed intermittently. On the other hand, the temperature sensor 74 may have poor responsiveness to temperature changes due to the heat capacity of the temperature sensor 74 and the characteristics of the temperature-sensitive material. In particular, cheaper temperature sensors tend to have poorer responsiveness. Thus, the temperature detection result Td cannot accurately follow the actual surface temperature Tr of the heat roller 71. That is, the temperature detection result Td is detected by the temperature sensor 74 in a state of being delayed with respect to the surface temperature Tr of the heat roller 71. Further, the temperature detection result Td is detected by the temperature sensor 74 in a smoothed state without reproducing a fine change in the surface temperature Tr of the heat roller 71.

The temperature estimation unit 81 performs a temperature estimation process (ACT 143). That is, the temperature estimation unit 81 generates a temperature estimation result EST, based on the temperature detection result Td, the power supply voltage detection result Sv, the estimation history PREV, and the energization pulse Ps. The temperature estimation unit 81 outputs the temperature estimation result EST to the high-frequency component extraction unit 83 and the estimation history holding unit 82.

The heat transfer can be expressed equivalently by the CR time constant of the electric circuit. The heat capacity is replaced by the capacitance C. The heat transfer resistance is replaced by the resistance R. The heat source is replaced by a DC voltage source. The temperature estimation unit 81 estimates the amount of heat given to the heat roller 71, based on a CR circuit in which the values of each element are set in advance based on the energization amount to the heater 73 and the heat capacity of the heat roller 71. The temperature estimation unit 81 estimates the surface temperature of the heat roller 71, based on the amount of heat given to the heat roller 71, the temperature detection result Td, and the estimation history PREV, and outputs the temperature estimation result EST.

In the temperature estimation unit 81, the energization and disconnection from the DC voltage source are repeated based on the energization pulse Ps, the CR circuit operates according to the input voltage pulse, and the output voltage is generated. Thereby, the heat propagated to the surface of the heat roller 71 to be controlled can be estimated.

The heat of the heat roller 71 flows out to the external environment through the space inside the fixing unit 21 (outside the heat roller 71). The temperature estimation unit 81 further includes a CR circuit for estimating the outflow of heat from the heat roller 71 to the external environment. Further, the temperature estimation unit 81 may further include a CR circuit for estimating the amount of heat flowing from the heat roller 71 into the space inside the fixing unit 21.

As shown in FIG. 9, the temperature estimation result EST appropriately follows the change in the actual surface temperature Tr of the heat roller 71. However, since the temperature estimation result EST is a simulation result, the absolute value may differ from the actual surface temperature Tr of the heat roller 71 due to differences in conditions and the like.

The high-frequency component extraction unit 83 performs a high-pass filter process for extracting the high-frequency component of the temperature estimation result EST (ACT 144). As shown in FIG. 9, the high-frequency component HPF, which is a signal indicating the high-frequency component of the temperature estimation result EST, appropriately follows the change in the actual surface temperature Tr of the heat roller 71.

The coefficient addition unit 84 performs a coefficient addition process for correcting the temperature detection result Td (ACT 145). The coefficient addition unit 84 multiplies the high-frequency component HPF by a preset coefficient and adds the high-frequency component HPF multiplied by the coefficient to the temperature detection result Td to calculate the corrected temperature value WAE. That is, the coefficient addition unit 84 calculates the corrected temperature value WAE by adjusting the value of the high-frequency component HPF to be added to the temperature detection result Td with a coefficient.

For example, if the coefficient is "1", the coefficient addition unit 84 directly adds the high-frequency component HPF to the temperature detection result Td. Further, for example, if the coefficient is "0.1", the coefficient addition unit 84 adds a value of 1/10 of the high-frequency component HPF to the temperature detection result Td. In this case, the effect of the high-frequency component HPF is almost eliminated, and the temperature is close to the temperature detection result Td. Further, for example, if the coefficient is "1" or more, the effect of the high-frequency component HPF can be expressed more strongly. Experiments show that the coefficient set in the coefficient addition unit 84 may not be a very extreme value, but a value near "1".

FIG. 10 is an explanatory diagram for explaining examples of the actual surface temperature Tr of the heat roller 71, the temperature detection result Td, and the corrected temperature value WAE. In the WAE control, a fine temperature change in the surface temperature Tr of the heat roller 71 is estimated, based on the temperature detection result Td and the high-frequency component HPF of the temperature estimation result EST. Therefore, as shown in FIG. 10, the corrected temperature value WAE is a value that appropriately follows the surface temperature of the heat roller 71.

The difference comparison unit 86 calculates the difference DIF between the target temperature TGT from the target temperature output unit 85 and the corrected temperature value WAE from the coefficient addition unit 84, and outputs the calculated difference DIF to the control signal generation unit 87 (ACT 146).

The control signal generation unit 87 generates energization pulses Ps based on the difference DIF. The control signal generation unit 87 outputs the energization pulse Ps to the power supply circuit 88 and the temperature estimation unit 81 (ACT 147). The power supply circuit 88 supplies the energizing power PC to the heater 73, based on the energization pulse Ps.

From the difference DIF, the relationship between the target temperature TGT and the corrected temperature value WAE is known. For example, in a case of the corrected temperature value WAE>the target temperature TGT, the energization amount to the heater 73 is reduced and the surface temperature Tr of the heat roller decreases, by controlling the width of the energization pulse Ps to be narrowed or the frequency to be reduced. Further, in a case of the corrected temperature value WAE<the target temperature TGT, the energization amount to the heater 73 is increased and the surface temperature Tr of the heat roller increases, by controlling the width of the energization pulse Ps to be wide or the frequency to be increased.

From the difference DIF, not only the hierarchical relationship but also the difference between the corrected temperature value WAE and the target temperature TGT can be grasped. For example, if the difference DIF (absolute value thereof) is a large value, the deviation between the corrected temperature value WAE and the target temperature TGT is large, so that the above control may be changed significantly. Further, for example, if the difference DIF (absolute value thereof) is a small value, the deviation between the corrected temperature value WAE and the target temperature TGT is small, so that the above control may be performed slowly.

The processor 24 of the system controller 13 determines whether or not to terminate the WAE control (ACT 148). If it is determined that the WAE control is to be continued (ACT 148, NO), the processor 24 shifts to the process of ACT 14. Further, if the processor 24 determines that the WAE control is terminated (ACT 148, YES), the processor 24 terminates the process of FIG. 8.

As described above, when performing a process for a certain cycle (the cycle), the heater energization control circuit 14 performs WAE control, based on values in the previous cycle (energization pulse Ps and temperature estimation result EST: estimation history PREV) and the temperature detection result Td and the power supply voltage detection result Sv in the cycle. That is, the heater energization control circuit 14 inherits the values in the next cycle. The heater energization control circuit 14 recalculates the temperature estimation calculation based on the history of the previous calculation. Therefore, the heater energization control circuit 14 constantly performs calculations during operation. In the heater energization control circuit 14, the calculation result is held in a memory or the like and reused in the calculation in the next cycle.

Figure 11:
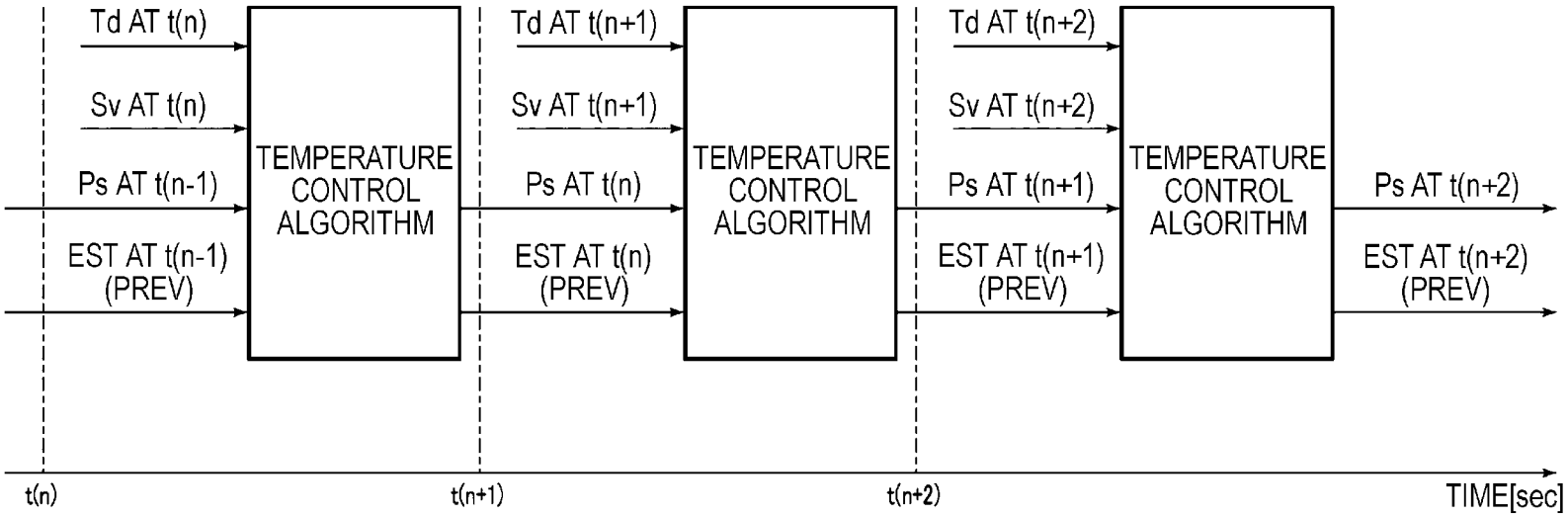
FIG. 11 is an explanatory diagram for explaining a processing cycle in a heater energization control circuit.

FIG. 11 is an explanatory diagram for explaining a processing cycle in the heater energization control circuit 14. The horizontal axis of FIG. 11 indicates time. For example, the temperature estimation unit 81 performs the temperature estimation process at the time t(n), then performs the next temperature estimation process at t(n+1) where the time advances by dt from the time t(n), and then performs the temperature estimation process at t(n+2) where the time additionally advances by dt. In this way, the temperature estimation unit 81 repeatedly performs the temperature estimation process. The temperature estimation unit 81 uses the previous temperature estimation result EST for new temperature estimation, in the temperature estimation process at each cycle.

At time t(n), the power supply voltage detection result Sv at time t(n), the temperature detection result Td at time t(n), the energization pulse Ps at the previous time t(n−1), and the temperature estimation result EST (estimation history PREV) at the previous time t(n−1) are input to the temperature estimation unit 81. The temperature estimation unit 81 performs a process based on the input signal, and outputs the temperature estimation result EST at time t(n). The high-frequency component extraction unit 83, the coefficient addition unit 84, the difference comparison unit 86, and the control signal generation unit 87 perform processes based on the input signal, and output the energization pulse Ps at time t(n).

At time t(n+1), the power supply voltage detection result Sv at time t(n+1), the temperature detection result Td at time t(n+1), the energization pulse Ps at the previous time t(n), and the temperature estimation result EST (estimation history PREV) at the previous time t(n) are input to the temperature estimation unit 81. The temperature estimation unit 81 performs a process based on the input signal, and outputs the temperature estimation result EST at time t(n+1). The high-frequency component extraction unit 83, the coefficient addition unit 84, the difference comparison unit 86, and the control signal generation unit 87 perform processes based on the input signal, and output the energization pulse Ps at time t(n+1).

At time t(n+2), the power supply voltage detection result Sv at time t(n+2), the temperature detection result Td at time t(n+2), the energization pulse Ps at the previous time t(n+1), and the temperature estimation result EST (estimation history PREV) at the previous time t(n+1) are input to the temperature estimation unit 81. The temperature estimation unit 81 performs a process based on the input signal, and outputs the temperature estimation result EST at time t(n+2). The high-frequency component extraction unit 83, the coefficient addition unit 84, the difference comparison unit 86, and the control signal generation unit 87 perform processes based on the input signal, and output the energization pulse Ps at time t(n+2).

The time interval dt may be a fixed value or may be set in the initial value setting of the ACT 141. For example, the time interval dt is set to 100 [msec].

Here, the difference in the accuracy of temperature control depending on the presence and absence of power supply voltage detection and WAE control will be described.

Figure 12:
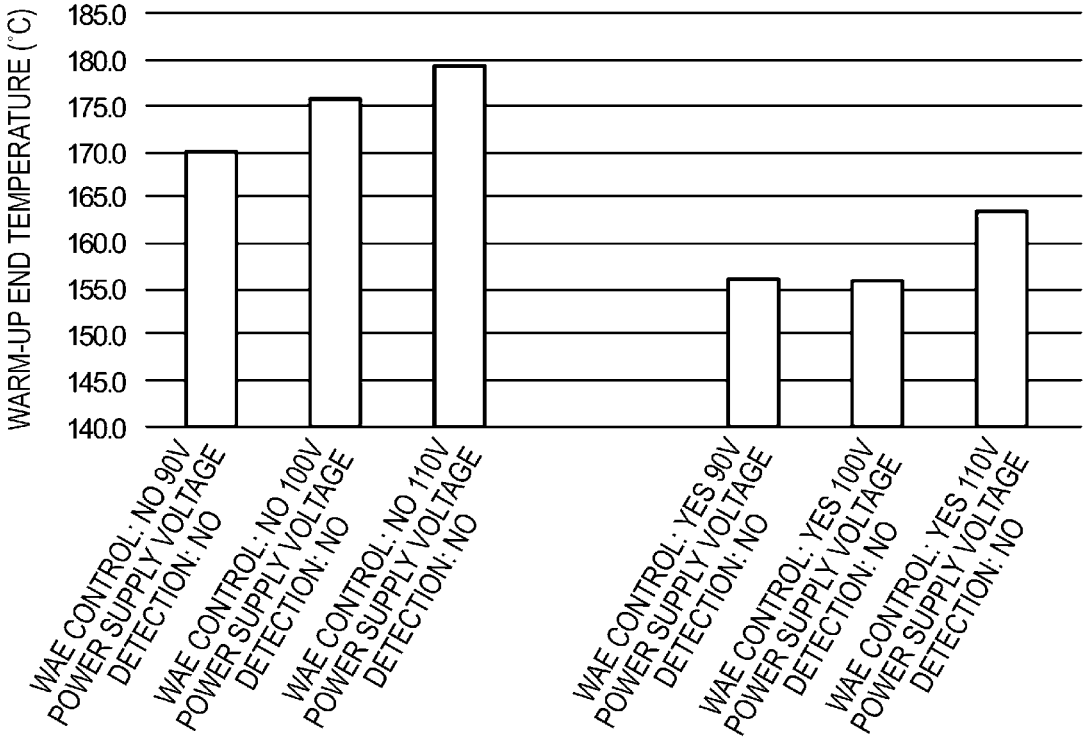
FIG. 12 is an explanatory diagram for explaining a warm-up end temperature if there is neither power supply voltage detection nor WAE control and a warm-up end temperature if there is only WAE control.

FIG. 12 is an explanatory diagram for explaining a warm-up end temperature if there is neither power supply voltage detection nor WAE control and a warm-up end temperature if there is only WAE control. The three graphs on the left show the former case, and the three graphs on the right show the latter case. Here, it is assumed that the rated voltage value is 100 V and the target temperature TGT at the time of warming up the surface temperature Tr of the heat roller is 155° C.

The temperature detection result Td from the temperature sensor 74 has a delay of, for example, about 2 seconds. Therefore, if there is neither power supply voltage detection nor WAE control, as shown in the middle graph on the left side of FIG. 12, even if 100 V is supplied as the rated power supply voltage, after the temperature reaches the target temperature 155° C., heating is additionally performed for 2 seconds, so that the temperature exceeds 175° C. If the power supply voltage is only 90V, which is lower than the rated voltage, if the temperature detection result Td also has a delay of 2 seconds, the energy input to the heater 73 is small, so that the temperature rise is small and the temperature reaches 170° C., as shown in the left graph on the left side of FIG. 12. On the contrary, if the power supply voltage is 110 V, which is higher than the rated voltage, if the temperature detection result Td also has a delay of 2 seconds, the input energy to the heater 73 is large, so that the temperature reaches close to 180° C., as shown in the right graph on the left side of FIG. 12.

On the other hand, if WAE control is performed, the surface temperature Tr of the heat roller is predicted by inputting the rated voltage value of 100 V and the temperature detection result Td, so that even if the temperature detection result Td does not reach 155° C. yet, it can be predicted that the surface temperature Tr of the heat roller reaches 155° C. Therefore, if there is WAE control, as shown in the middle graph on the right side of FIG. 12, if 100V is supplied as the rated power supply voltage, the surface temperature Tr of the heat roller can be set to substantially the target temperature 155° C. Further, even if only 90 V, which is lower than the rated voltage, is applied, the input energy to the heater 73 is small, so that the temperature does not deviate much from the target temperature 155° C., as shown in the left graph on the right side of FIG. 12. However, if the power supply voltage is 110 V, which is higher than the rated voltage, the input energy to the heater 73 is high, so that the temperature exceeds 160° C., as shown in the right graph on the right side of FIG. 12. As described above, even if the WAE control is performed, it is not easy to prevent the occurrence of overshoot if the power supply voltage is higher than the rated voltage.

Figure 13:
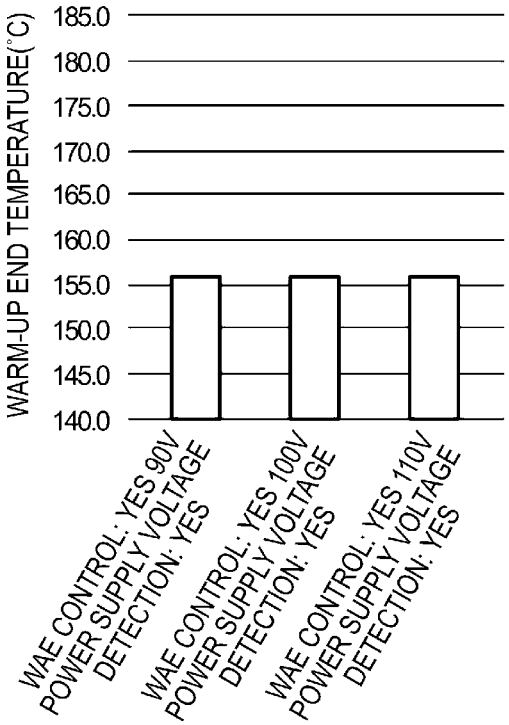
FIG. 13 Prior Art
FIG. 13 is an explanatory diagram for explaining a warm-up end temperature according to a power supply voltage value by WAE control using a power supply voltage detection result.

Therefore, when predicting the surface temperature Tr of the heat roller, the power supply voltage detection result Sv is used as in the present embodiment. FIG. 13 is an explanatory diagram for explaining a warm-up end temperature according to a power supply voltage value by WAE control using the power supply voltage detection result Sv. The heater energization control circuit 14 detects the power supply voltage by its own apparatus or acquires the detection result by another apparatus, and controls the energization to the heater 73 according to the power supply voltage. Therefore, as shown in FIG. 13, even if the actual power supply voltage value is 90 V, which is lower than the rated voltage, or on the contrary, the actual power supply voltage value is 110V, which is higher than the rated voltage, the surface temperature Tr of the heat roller can be controlled to a target temperature 155° C., which is the same as the case where the rated voltage value 100V is supplied.

In the above description, the case of the image forming system including the host computer 2 is described as an example, but the host computer 2 may not be provided. In this case, the first image forming apparatus 1A does not perform the process of ACT 1A2 in FIG. 5. Then, in the ACT 1A6, in the same manner as the second image forming apparatus 1B connected to the first image forming apparatus 1A by an in-house LAN or the like which is a network different from the network NW, an inquiry about the power supply voltage value of the power supply voltage detection result Sv from the second image forming apparatus 1B connected via the network NW is received. However, the second image forming apparatus 1B connected via the network NW needs transmission destination information such as the network address of the first image forming apparatus 1A. Further, if the first image forming apparatus 1A and the second image forming apparatus 1B connected via the network NW are different companies or the like, it is necessary to prepare appropriate security measures. A usage fee for the first image forming apparatus 1A may be incurred from the company that uses the second image forming apparatus 1B.

As described above, the second image forming apparatus 1B includes the fixing unit 21, the temperature sensor 74, the heater energization control circuit 14, the communication interface 12, and the processor 24. The fixing unit 21 has a heat roller 71 that heats the toner image formed on the medium and fixes the toner image on the medium, and a heater 73 that heats the heat roller 71. The temperature sensor 74 detects the temperature of the heat roller 71 to which heat propagates from the heater 73, and outputs the temperature detection result Td. The heater energization control circuit 14 estimates the surface temperature Tr of the heat roller 71, based on the temperature detection result Td, the power supply voltage value of the power supply source, and the energization pulse Ps for controlling the energization to the heater 73, and outputs the energization pulse Ps for controlling the electric power to be supplied to the heater 73, based on the estimated surface temperature Tr of the heat roller 71 and the temperature detection result Td. The communication interface 12 communicates with another apparatus via the network. The processor 24 acquires a power supply voltage detection result Sv by the communication interface 12 via the network, from the other apparatus which holds the power supply voltage detection result Sv by a first image forming apparatus 1A provided with a power supply voltage detecting device 23 that detects a power supply voltage value of a same power supply source as the power supply source, and inputs the acquired power supply voltage detection result Sv to the heater energization control circuit 14, as a power supply voltage value of the power supply source.

According to such a configuration, in the second image forming apparatus 1B having no power supply voltage detecting device 23, it becomes possible to execute WAE control by using the power supply voltage detection result Sv detected by the power supply voltage detecting device 23 of the first image forming apparatus 1A supplied with power from the same power supply source. Thus, even in the second image forming apparatus 1B having no power supply voltage detecting device 23, the surface temperature Tr of the heat roller 71 can be accurately controlled as in the first image forming apparatus 1A provided with the power supply voltage detecting device 23.

Further, the processor 24 transmits an inquiry about the power supply voltage detection result Sv to another apparatus via the network by the communication interface 12 at the time of startup of its own apparatus, receives the power supply voltage detection result Sv returned in response to the inquiry, and stores the received power supply voltage detection result Sv in the memory 25. This enables accurate temperature control from warm-up at the time of startup.

If the processor 24 does not receive the reply of the power supply voltage detection result Sv in response to the inquiry at the time of startup, the processor 24 stores the rated voltage value as the power supply voltage value of the power supply source in the memory 25. Thus, if any first image forming apparatus 1A does not detect the power supply voltage, it is possible to perform a warm-up with the designed value without waiting for the reply of the power supply voltage detection result Sv. Therefore, it is possible to eliminate the risk of unnecessarily waiting for the user who wants to form an image.

Further, if the temperature detection result Td is a specified temperature, for example, 50° C. or lower when returning from the sleep state, the processor 24 further transmits an inquiry about the power supply voltage detection result Sv to the other apparatus via the network by the communication interface 12, receives the power supply voltage detection result Sv returned in response to the inquiry, and stores the received power supply voltage detection result Sv in the memory 25. If the surface temperature Tr of the heat roller 71 is not significantly lowered, the warm-up operation is unnecessary, and even if the power supply voltage detection result is slightly different from the current power supply voltage value, the temperature control is not significantly affected. Therefore, in such a case, the processing time related to the communication can be shortened and the power can be saved by omitting the useless communication.

Further, the processor 24 transmits an inquiry about the power supply voltage detection result Sv to the other apparatus via the network by the communication interface 12 at regular intervals, for example, every 10 minutes, receives the power supply voltage detection result Sv returned in response to the inquiry, and updates the power supply voltage detection result Sv stored in the memory 25. Thus, control based on a new power supply voltage detection result Sv, that is, a power supply voltage detection result Sv that is most likely to match the current situation becomes possible.

Here, if the processor 24 does not receive the reply of the power supply voltage detection result Sv in response to the inquiry, the processor 24 maintains the power supply voltage detection result Sv stored in the memory 25. Thus, control using the power supply voltage detection result Sv can be continued.

Further, if the processor 24 receives the inquiry about the power supply voltage detection result Sv from the other second image forming apparatus 1B via the network by the communication interface 12, the processor 24 returns the power supply voltage detection result Sv stored in the memory. As a result, it is not necessary to connect all the second image forming apparatuses 1B to the first image forming apparatus 1A or the host computer 2. For example, one second image forming apparatuses 1B is connected to the network NW, and the other second image forming apparatuses 1B are connected to the one second image forming apparatus 1B via an in-house LAN or the like which is a network different from the network NW. By doing so, control using the power supply voltage detection result Sv becomes possible in all the second image forming apparatuses 1B. If the network NW is an external network, one apparatus can be connected to the outside, and it is easy to ensure security.

The other apparatus can include the first image forming apparatus 1A. In this case, the processor 24 inquires the power supply voltage detection result Sv of the first image forming apparatus 1A via the network by the communication interface 12. As a result, it is possible to configure an image forming system without the host computer 2.

Alternatively, the other apparatus can include a host computer 2 that stores the power supply voltage detection result Sv detected by the first image forming apparatus 1A. In this case, the processor 24 inquires the power supply voltage detection result Sv of the host computer 2 via the network NW by the communication interface 12. By passing through the host computer 2 managed by the building management company, or the like, even between a plurality of companies that do not have a business relationship in the same building with the same power supply source, the power supply voltage detection result Sv can be used while maintaining security.

Further, the other apparatus is the other second image forming apparatus 1B, and includes the other second image forming apparatus 1B that receives the power supply voltage detection result Sv detected by the first image forming apparatus 1A and stores the received power supply voltage detection result Sv in the memory 25. In this case, the processor 24 inquires the power supply voltage detection result Sv of the other second image forming apparatus 1B via the network by the communication interface 12. As a result, it is possible to use the power supply voltage detection result Sv received and held by the other second image forming apparatus 1B.

The functions described in each of the above-described embodiments are not limited to the configuration using hardware, and can be achieved by loading a program describing each function into a computer using software. Further, each function may be configured by appropriately selecting either software or hardware.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a fixing component including a fixing rotating body that heats a toner image formed on a medium and fixes the toner image on the medium, and a heating member that heats the fixing rotating body;

a temperature sensor that detects a temperature of the fixing rotating body to which heat propagates from the heating member, and outputs a temperature detection result;

a heating member energization control circuit that estimates the temperature of the fixing rotating body, based on the temperature detection result, a power supply voltage of a power supply source, and an energization pulse for controlling energization to the heating member, and outputs an energization pulse for controlling power to be supplied to the heating member based on the estimated temperature of the fixing rotating body and the temperature detection result;

a communication interface that communicates with another apparatus via a network; and a controller that acquires, from the another apparatus which holds a power supply voltage detection result by an image forming apparatus with a power supply voltage detection function, provided with a power supply voltage detection circuit that detects a power supply voltage value of a same power supply source as the power supply source, the power supply voltage detection result by the communication interface via the network, and inputs the acquired power supply voltage detection result to the heating member energization control circuit, as the power supply voltage value of the power supply source.

2. The image forming apparatus according to claim 1, wherein if the image forming apparatus is started up, the controller transmits an inquiry about the power supply voltage detection result to the another apparatus via the network by the communication interface, receives the power supply voltage detection result returned in response to the inquiry, and stores the received power supply voltage detection result in a memory.

3. The image forming apparatus according to claim 2, wherein if the controller does not receive a reply of the power supply voltage detection result in response to the inquiry, the controller stores a rated voltage value as the power supply voltage value of the power supply source in the memory.

4. The image forming apparatus according to claim 2, wherein in a case where the temperature detection result is a specified temperature or lower when returning from a sleep state, the controller further transmits an inquiry about the power supply voltage detection result to the other apparatus via the network by the communication interface, receives the power supply voltage detection result returned in response to the inquiry, and stores the received power supply voltage detection result in the memory.

5. The image forming apparatus according to claim 2, wherein the controller further transmits an inquiry about the power supply voltage detection result to the another apparatus via the network by the communication interface at regular intervals, receives the power supply voltage detection result returned in response to the inquiry, and updates the power supply voltage detection result stored in the memory.

6. The image forming apparatus according to claim 5, wherein in a case where the controller does not receive a reply of the power supply voltage detection result in response to the inquiry, the controller maintains the power supply voltage detection result stored in the memory.

7. The image forming apparatus according to claim 2, wherein if the controller receives an inquiry about the power supply voltage detection result, from another image forming apparatus different from the image forming apparatus with the power supply voltage detection function via the network by the communication interface, the controller returns the power supply voltage detection result stored in the memory.

8. The image forming apparatus according to claim 1, wherein the another apparatus includes the image forming apparatus with the power supply voltage detection function, and the controller inquires the power supply voltage detection result of the image forming apparatus with a power supply voltage detection function via the network by the communication interface.

9. The image forming apparatus according to claim 1, wherein the another apparatus includes a host computer that stores the power supply voltage detection result detected by the image forming apparatus with the power supply voltage detection function, and the controller inquires the power supply voltage detection result of the host computer via the network by the communication interface.

10. The image forming apparatus according to claim 1, wherein the another apparatus includes another image forming apparatus that is different from the image forming apparatus with the power supply voltage detecting function and that receives the power supply voltage detection result detected by the image forming apparatus with the power supply voltage detection function and stores the power supply voltage detection result in the memory, and the controller inquires the power supply voltage detection result of the another image forming apparatus via the network by the communication interface.

11. A method for an image forming apparatus, comprising:

detecting a temperature of a fixing rotating body to which heat propagates from a heating member of a fixing component, and outputting a temperature detection result;

estimating the temperature of the fixing rotating body, based on the temperature detection result, a power supply voltage of a power supply source, and an energization pulse for controlling energization to the heating member, and outputting an energization pulse for controlling power to be supplied to the heating member based on the estimated temperature of the fixing rotating body and the temperature detection result;

communicating with another apparatus via a network; and acquiring, from the another apparatus which holds a power supply voltage detection result by an image forming apparatus with a power supply voltage detection function, provided with a power supply voltage detection circuit that detects a power supply voltage value of a same power supply source as the power supply source, the power supply voltage detection result by the communication interface via the network, and inputting the acquired power supply voltage detection result, as the power supply voltage value of the power supply source.

12. The method according to claim 11, wherein if the image forming apparatus is started up, transmitting an inquiry about the power supply voltage detection result to the another apparatus via the network, receiving the power supply voltage detection result returned in response to the inquiry, and storing the received power supply voltage detection result in a memory.

13. The method according to claim 12, wherein if no reply of the power supply voltage detection result in response to the inquiry is received, storing a rated voltage value as the power supply voltage value of the power supply source in the memory.

14. The method according to claim 12, wherein in a case where the temperature detection result is a specified temperature or lower when returning from a sleep state, transmitting an inquiry about the power supply voltage detection result to the other apparatus via the network, receiving the power supply voltage detection result returned in response to the inquiry, and storing the received power supply voltage detection result in the memory.

15. The method according to claim 12, further comprising:

transmitting an inquiry about the power supply voltage detection result to the another apparatus via the network at regular intervals, receiving the power supply voltage detection result returned in response to the inquiry, and updating the power supply voltage detection result stored in the memory.

16. The method according to claim 5, wherein in a case where no reply of the power supply voltage detection result in response to the inquiry is received maintaining the power supply voltage detection result stored in the memory.

17. The method according to claim 12, wherein if an inquiry about the power supply voltage detection result is received, from another image forming apparatus different from the image forming apparatus with the power supply voltage detection function via the network, returning the power supply voltage detection result stored in the memory.

18. The method according to claim 11, wherein the another apparatus includes the image forming apparatus with the power supply voltage detection function, and further comprising:

inquiring the power supply voltage detection result of the image forming apparatus with a power supply voltage detection function via the network.

19. The method according to claim 11, wherein the another apparatus includes a host computer that stores the power supply voltage detection result detected by the image forming apparatus with the power supply voltage detection function, and further comprising:

inquiring the power supply voltage detection result of the host computer via the network.

20. The method according to claim 11, wherein the another apparatus includes another image forming apparatus that is different from the image forming apparatus with the power supply voltage detecting function and that receives the power supply voltage detection result detected by the image forming apparatus with the power supply voltage detection function and stores the power supply voltage detection result in the memory, and further comprising:

inquiring the power supply voltage detection result of the another image forming apparatus via the network.

21. A temperature regulation system for an image forming apparatus, comprising:

a temperature sensor that detects a temperature of a fixing rotating body to which heat propagates from a heating member of a fixing component, and outputs a temperature detection result;

a heating member energization control circuit that estimates the temperature of the fixing rotating body, based on the temperature detection result, a power supply voltage of a power supply source, and an energization pulse for controlling energization to the heating member, and outputs an energization pulse for controlling power to be supplied to the heating member based on the estimated temperature of the fixing rotating body and the temperature detection result;

a communication interface that communicates with another apparatus via a network; and a controller that acquires, from the another apparatus which holds a power supply voltage detection result by an image forming apparatus with a power supply voltage detection function, provided with a power supply voltage detection circuit that detects a power supply voltage value of a same power supply source as the power supply source, the power supply voltage detection result by the communication interface via the network, and inputs the acquired power supply voltage detection result to the heating member energization control circuit, as the power supply voltage value of the power supply source.

* * * * *